US009404230B2

(12) United States Patent
Habodasz

(10) Patent No.: US 9,404,230 B2
(45) Date of Patent: Aug. 2, 2016

(54) MODULAR TOP SHIELD FOR SUPPORT COLUMN

(71) Applicant: Anthony P. Habodasz, Troy, OH (US)

(72) Inventor: Anthony P. Habodasz, Troy, OH (US)

( * ) Notice: Subject to any disclaimer, the term of this patent is extended or adjusted under 35 U.S.C. 154(b) by 0 days.

(21) Appl. No.: 14/885,121

(22) Filed: Oct. 16, 2015

(65) Prior Publication Data

US 2016/0108588 A1 Apr. 21, 2016

Related U.S. Application Data

(60) Provisional application No. 62/065,248, filed on Oct. 17, 2014.

(51) Int. Cl.

| | |
|---|---|
| ***E04H 12/00*** | (2006.01) |
| ***E01D 19/08*** | (2006.01) |
| ***E04C 3/30*** | (2006.01) |
| ***E04B 1/64*** | (2006.01) |
| *E04H 17/00* | (2006.01) |

(52) U.S. Cl.

CPC ..... *E01D 19/08* (2013.01); *E04B 1/642* (2013.01); *E04C 3/30* (2013.01); *E04H 2017/006* (2013.01)

(58) Field of Classification Search

CPC ..... E04D 1/642; E04D 3/405; E04C 3/30; E04C 5/161; E04H 12/2292; E04H 2017/006

USPC ..... 52/300

See application file for complete search history.

(56) References Cited

U.S. PATENT DOCUMENTS

| | | | | |
|---|---|---|---|---|
| 542,675 | A * | 7/1895 | Braley | E04C 5/161 174/5 R |
| 1,489,204 | A * | 4/1924 | Glen | 52/295 |
| 1,532,734 | A * | 4/1925 | Dean | E04H 12/2292 52/170 |
| 3,416,270 | A | 12/1968 | McHugh | |
| 4,848,049 | A | 7/1989 | Hanson | |
| 4,970,837 | A | 11/1990 | Fogelstrom | |
| 5,832,675 | A | 11/1998 | Zuares | |
| 5,920,937 | A | 7/1999 | Tracy | |
| 6,098,353 | A | 8/2000 | Stanfield | |
| 6,257,557 | B1 | 7/2001 | Anderson et al. | |
| 6,449,911 | B1 | 9/2002 | Hudson | |
| 7,107,727 | B2 | 9/2006 | Nelsen | |
| 7,470,091 | B2 | 12/2008 | Scholl | |
| 8,177,180 | B2 | 5/2012 | Plaisted et al. | |
| 2008/0000192 | A1 | 1/2008 | McGlinch | |
| 2009/0273261 | A1 * | 11/2009 | Fournier | H02G 3/081 312/237 |

* cited by examiner

*Primary Examiner* — Brian Mattei
(74) *Attorney, Agent, or Firm* — Mattingly & Malur, PC

(57) ABSTRACT

A shield is provided on top of a support column that protects liquid or debris from falling onto the support column from the structure above. Additionally, gaskets are provided around the center of the shield to contact components on top of the support column to further provide protection from liquid and debris. The shield is sloped and provides channels to guide liquid or debris and the outer most edge of the shield extends beyond the outer most surface of the support column in the radial direction whether the support column uses a cover or not. The shield may be in a rounded or quadrilateral form and is manufactured in segments to be connected upon installation using a clam shell type design. Mechanical connection schemes including a collar or fastener are provided to secure the shield segments in a connected state.

11 Claims, 25 Drawing Sheets

MODULAR TOP SHIELD FOR SUPPORT COLUMN

This application claims the benefit of U.S. Provisional Application No. 62/065,248 filed Oct. 17, 2014.

FIELD OF THE INVENTION

The invention relates to a modular top cover or shield for covering the top end of a support structure.

BACKGROUND OF THE INVENTION

Corrosion of reinforcing bars and pre-stressed tendons is one of the most significant and unremitting factors related to the deterioration of bridges. Of approximately 500,000 bridges in the United States, about 80,000 of these are rated structurally deficient. Corrosion of bridge components is the underlying cause of many of the deficiency ratings, with many additional bridges showing early signs of imminently serious corrosion. In combination with water and oxygen, the main cause of corrosion is the chemical reaction of chloride ions originating from: (1) de-icing salts applied to roadways in regions where snow accumulation may be significant; or (2) saltwater that is commonly present in settings adjacent to marine environments. Chloride ions that penetrate concrete can react with underlying steel reinforcement. This reaction can expand the reinforcement and cause the overlying concrete to crack, spalling, and de-bond. This degradation may be further accelerated by vibration from traffic. The shield of the present invention is aimed at deterring the corrosive action of roadway solutions on the vertical surfaces—i.e. the splash zone. An additional threat to bridge infrastructure includes corrosion and deterioration of components within the pier cap area, which occurs below the road deck and at the top of the supporting column.

The pier cap area houses a bearing assembly. Bearing assemblies vary in their sizes and designs but typically consist of: (1) a pedestal that is anchored to the top of the pier cap; and (2) an overlying bearing that supports the underside of the road deck while accommodating limited structural movement. The bearing assembly and overall pier cap area is susceptible to corrosion and deterioration that mainly results from solutions entering the area from the above roadway. (An example of this is a salt solution that may bypass expansion joints within an overlying road deck.)

Typically, the pedestal is anchored to the top of the pier cap. As a result of the wicking effect from the roadway above, at the point of attachment, road solution may penetrate the concrete. This penetration propagates downward fracturing the concrete. Over time, the concrete is slowly eaten away thereby removing the static compressive surface that supports the bridge.

SUMMARY OF THE INVENTION

An object of the present invention is to provide a top shield that deters the corrosion and deterioration of components within the pier cap area. To further the goal, it is an object to eliminate any road solution (liquid or debris) from ever contacting the main body of the bearing along with the top of the pier cap.

A gasket is provided which may consist of a blade of flexible material that fits snugly around the vertical sidewall of the bearing or undersurface of the beam without the use of an adhesive, although this is not a limitation. In one example, the flexible material is applied under slight compression to keep solutions from infiltrating the bearing assembly while allowing for mobility (e.g., thermal expansion and contraction) of the bearing.

The top shield may also be used in conjunction with a gasket assembly, which includes the aforementioned gasket. The top shield further diverts solution away from the bearing assembly and pier cap. The top shield consists of a clam-shell design that allows for quick removal and convenient inspection of the pier cap area. In cases where the height of a bearing assembly is very large, a beam bracket may be required for assembly. Those having ordinary skill in the art recognize that pier caps and bearing assemblies exist in different configurations, and therefore the design of the top shield may be altered to fit a respective pier caps and bearing assemblies while still encompassing the spirit of the invention. Further, although the invention is described herein with reference to the following figures, top shields and gasket assemblies may be designed without departing from the spirit of the invention according to the application of the top shield and gasket assembly combination. The top surfaces of the top shield of the present invention are also angled to shed liquid and debris away from the center of the shield.

In an embodiment, the top shield is substantially round, which consists of semicircular segments, although this is not a limitation or a requirement. The assembled shield includes a central opening that accommodates the bearing and surrounding gasket assembly. Radial aligned grooves direct solution away from the central area of the shield and downward toward sets of concentric channels. These channels allow for solution to flow toward the outer margins and then off the shield. A semicircular shaped connector is compressed and frictionally fit into indentations within the two segments of the shield. This connector provides: (1) a mechanical linkage between the two segments of the shield; and (2) a means of anchoring the gasket and umbrella shield assemblies to the top of support structures.

Another embodiment provides an umbrella shield that has a square or rectangular profile. This umbrella of this embodiment includes: (1) a central opening that accommodates the bearing and surrounding gasket assembly; (2) four faces that slope away from the center of the shield; and (3) supports that rest on the upper surface of the pier cap. The shield segments of may be connected by securing raised anchors with wraps or cable ties.

One embodiment provides ridges on left and right sides of the shield that diverts solution toward the front and rear of the shield, thus inhibiting flow towards laterally-adjacent sections of a supporting beam. The left and right ridges also allow for the inclusion of an assembly bracket that may be fastened with rivet or bolts or some other type of mechanical attachment.

Another embodiment of the shield includes a channel or rain gutter type element around the periphery of the shield that allows for relatively even dispersion of solution away from the shield. Further, in an embodiment, the outer margins of the shield extend beyond the diameter of an outer cover of a support column, which allows solutions diverted by the shield assembly to fall below (e.g., directly to the ground) without contacting the support column or an outer shield of the support column, if covered.

DETAILED DESCRIPTION OF THE PREFERRED EMBODIMENTS

Figure 1:
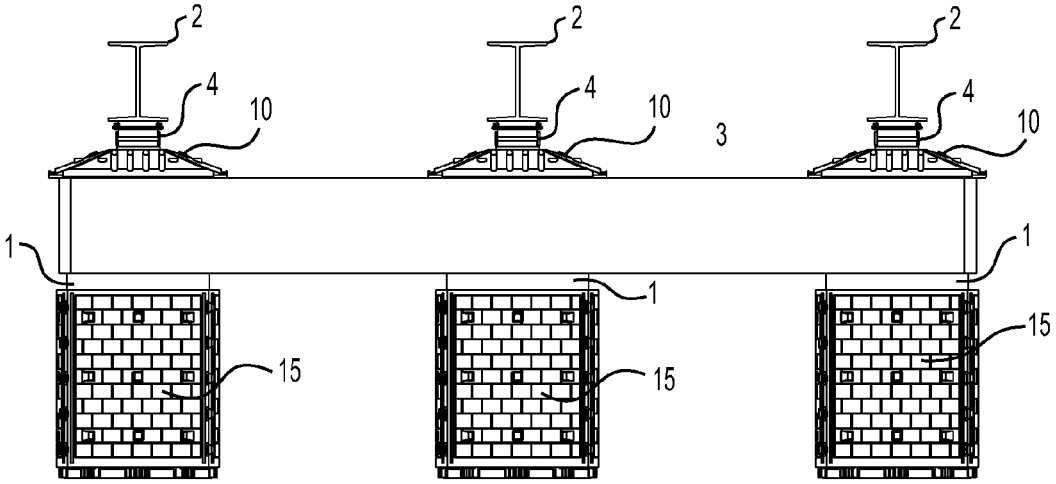
FIG. 1 is a perspective view of three top shields each covering a support column according to an embodiment of the present invention.

In the following detailed description, reference is made to the accompanying drawings which form a part of the disclosure, and in which are shown by way of illustration, and not of limitation, exemplary embodiments by which the invention may be practiced. In the drawings, like numerals describe substantially similar components throughout the several views. Further, it should be noted that while the detailed description provides various exemplary embodiments, as described below and as illustrated in the drawings, the present invention is not limited to the embodiments described and illustrated herein, but can extend to other embodiments, as would be known or as would become known to those skilled in the art. Reference in the specification to "one embodiment," "an embodiment," "this embodiment," or "these embodiments" means that a particular feature, structure, or characteristic described in connection with the embodiment is included in at least one embodiment of the invention, and the appearances of these phrases in various places in the specification are not necessarily all referring to the same embodiment. Additionally, in the following detailed description, numerous specific details are set forth in order to provide a thorough understanding of the present invention. However, it will be apparent to one of ordinary skill in the art that these specific details may not all be needed to practice the present invention. In other circumstances, well-known structures, materials, have not been described in detail, and/or may be illustrated in block diagram form, so as to not unnecessarily obscure the present invention.

Although the examples of the uses of the modular shield refer to covering support structures, which are column supports for a bridge or an overpass, the invention is not limited to that use. The shield may be adapted and modified to fit around structures of many shapes and sizes. Additionally, the shield segments of the modular shield may be injection molded, by standard plastic manufacturing process methods & materials, such as thermoforming, blow molding, compression, rotomold, and forms of injection molded processes. The shield segments are preferably made of high density polyethylene. The shield segments may be structured according to the shape of the support structure to be covered, e.g., a column of circular cross section or column of quadrilateral cross section. The present invention is not limited to any of the mold process listed above.

It should be further understood by those skilled in the art that although the foregoing description has been made on embodiments of the invention, the invention is not limited thereto and various changes and modifications may be made without departing from the spirit of the invention and the scope of the appended claims.

The present invention relates to a top cover or shield that placed on the top end of a support column to protect the top surfaces of the column and shed water and debris away from the column itself. Although not a limitation or a requirement, the shield is typically made of polyethylene thermoform, is lightweight, UV protective and may be formed in different colors and different textures to blend in with its environment when installed. In addition, the top shield may be made of a clam shell design, which allows for ease of installation and removal.

Support columns may be of a substantially circular or quadrilateral profile or may be of a shape having many sides. The shield, although shown to be substantially square or rounded may be configured to protect the support column and other structural features no matter the profile shape. Throughout the description the radial direction may be used to describe elements of the shield segments 112 even though the shield segments 112 are not in the shape of complete circles. Rather the segments may be semi-circular in shape.

FIG. 1 is a perspective view of three top shields each covering a support column according to an embodiment of the present invention. FIG. 1 shows a typical structural arrangement including three support columns 1, which are exemplary support columns 1 of those used to support a bridge or overpass used by vehicles, for example. In FIG. 1, there is a horizontal member 3 connecting each of the support columns 1 which is part of the structure of the bridge. Throughout the disclosure, the support columns 1, horizontal member 3, and other parts of the support structure are described as being made of concrete or having an outer layer of concrete. However, the shield 10 of the present invention may be applied to support structures composed of materials other than concrete. The top of the support column 1 is shown to include a bearing block 4 and the shield segments 12 may be formed in a corresponding shape. FIG. 1 shows a bearing block 4 supporting an I-beam 2. As is apparent in the figures, in some embodiments the outline shape of the shield 10 may be quadrilateral, in other cases the shape may be round. The shield 10 may be formed to correspond to many shapes or structures of the bearing block 4 and is not limited to what is shown. When the shield segments 12 are assembled to form a shield 10, the shield has an open center 26. In addition, although not a limitation or requirement, the support columns 1 shown in at least FIG. 1 each have a column support cover 15, which is a protective layer around the outside of column surface shielding the outer surface (e.g., concrete) of the support column 1 from liquid and/or debris. An exemplary column support cover 15 is shown in commonly owned and presently pending U.S. application Ser. No. 14/143,974.

Figure 2:
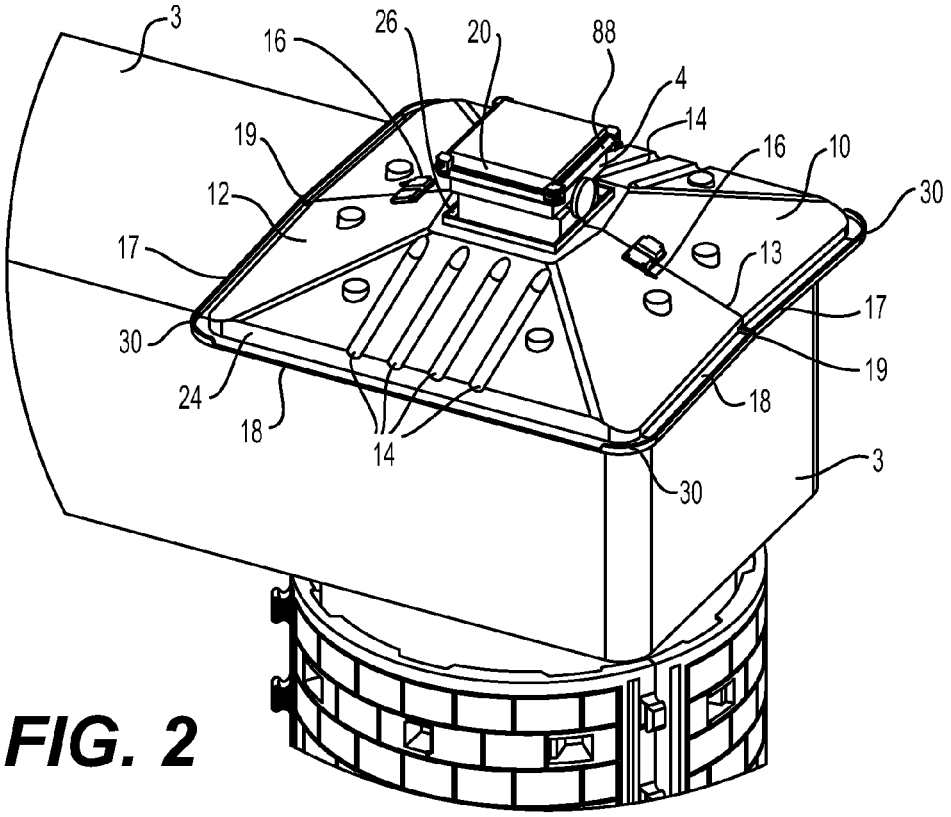
FIG. 2 is a perspective view of shield segments connected to form a shield according to an embodiment of the present invention.

FIG. 2 is a perspective view of shield segments connected to form a shield according to an embodiment of the present invention. As shown the shield 10 is arranged on top of the support column 1 and horizontal member 3. As will become apparent in the following figures and descriptions, the shield 10 may be composed of two shield segments 12 joined together at a seam 13. Throughout the following description, the shield 10 is described as being in two segments 12, which are joined/connected together to form the shield 10. However, the shield 10 may formed of more than two segments 12 without departing from the spirit of the invention. Forming the shield in two segments 12 allows for ease of installation (assembly) and removal (disassembly). The segment design also allows for repairs to the structure (e.g., support column, bearing block etc.) to be conducted easily since only a segment of the shield needs to be removed to uncover an area that needs to be repaired or further inspected.

The edges along the seam 13 engage each other in a tongue and groove arrangement 35, although the structure of the parts of the shield segments 12 that engage each other are not limited to the tongue and groove structure 35. The shield segments 12 are held in the engaged arrangement to form a shield using fasteners around joining members 16. The flexible fasteners allow a person to easily install and remove the shield as necessary as compared to a permanent fastener.

As mentioned above, it is an object of the present invention to provide a shield 10 that prevents liquid (e.g., rain water, solution) and other particulate (e.g., debris) from falling onto the surface of the support column 1 or the bearing block 4. In particular, the structure of the shield 10 is formed such that liquid and debris that falls onto the shield is directed away from the center of the shield. Further, the liquid and debris is guided away from two sides (of four) of the shield. Instead the liquid and debris is guided off the other of the two sides (not having a vertical extending lip 17).

In FIG. 2, the shield composed of two shield segments and has four outer edges 18. In FIG. 2, the two outer edges 18 having the vertical extending lip 17 are opposite to each other and the outer edges 18 that do not have the vertical lip 17 are opposite to each other. The shield 10 is pitched (i.e., sloped, graded, or drafted) to bias liquid or debris away from the center and allow the liquid or debris to fall away using gravity along the outer edges 18 not having the vertical extending lip 17. In other words, the two outer edges 18 that do not have vertical extending lips 17 allow liquid and debris to run off the edge (to the ground surface below). One purpose of having two outer edges 18 that include the vertical extending lips 17 is to prevent liquid or debris from falling onto the horizontal member 3. As mentioned above, liquid or debris falling onto the horizontal member 3 can degrade the material of the horizontal member 3. In some embodiments, the top surface of the shield segments 12 are drafted away from the seam 13 to direct liquid and debris away from the edges of the segments 12 constituting the tongue and groove connections 35.

Referring to FIG. 2, the outer edges 18 have a thickness extending in the vertical direction (i.e. toward the ground). The thickness is shown as a face along the outer edge 18 in FIGS. 2 and 4 in the outer edges 18 not having the upward extending vertical lip 17. This face prevents liquid from curling back under the outer edge 18 and dripping below. Rather, the liquid falls off the outer edge 18 without curling under. In the alternative, edges 18 may not have a thickness so as to prevent liquid from curling back under the outer edge 18 and dripping below. Rather, the edges 18 may also include a downward extending vertical edge.

Further, the outer edges 18 are stepped down from the top surface of the shield 10 and extend outward, as mentioned above. As a result of outer edge 18 being stepped down from the top surface of the shield, a vertical face 24 is provided. The vertical extending lip 17 also forms a channel for liquid or debris to guide liquid or debris around the corners to the outer edges 18 not having the vertical lip 17. One vertical boundary of the channel is the vertical face of the shield segment 24.

Another vertical boundary of the channel formed is the inner facing surface of the vertical extending lip 17. The channel is also formed by outer edge 18.

Channels 14 are formed as grooves in the top surface of the shield segments 12 and as grooves in the face 24 of the shield segments. The channels 14 along with the slope of the shield segments 12 guide liquid and debris away and off of the top surface of the shield 10 onto the outer edges 18. In addition, the channels 14 provide structure to the shield segments. The channels 14 also provide for structure during the molding process of the shield segments 12.

A rounded corner vertical extending lip 30 is also provided which guides liquid/debris so that the liquid/debris in the channel (formed by the inner facing surface of the vertical extending lip 17 and vertical face of shield segment 24) is further prevented from falling off the shield 10 until the rounded corner vertical lip 30 tapers off to the adjacent outer edge 18, as shown. The vertical component (height) of the rounded corner vertical lip 30 tapers to be flat with the outer edge 18 on one side, while the vertical component on the other side of the corner 30 is the same height as the vertical lip 17. Alternatively, the rounded corner vertical lip 30 may be not be tapered at one end to be flush with the outer edge 18, rather the rounded corner vertical lip 30 may have a straight edge (at a 90 degree angle or other angle) joining the adjacent outer edge 18.

Figure 6:
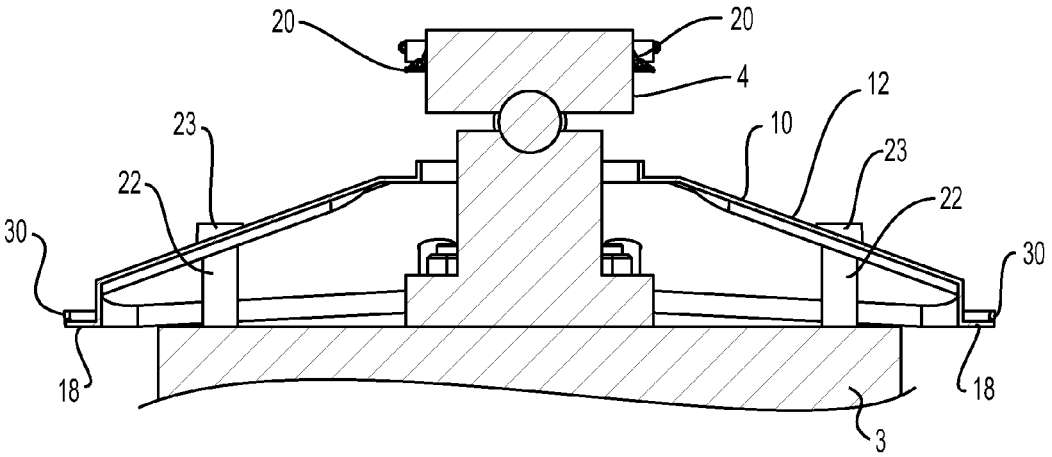
FIG. 6 is a cross sectional view of the top shield along the line 6-6 of FIG. 5.
Figure 7:
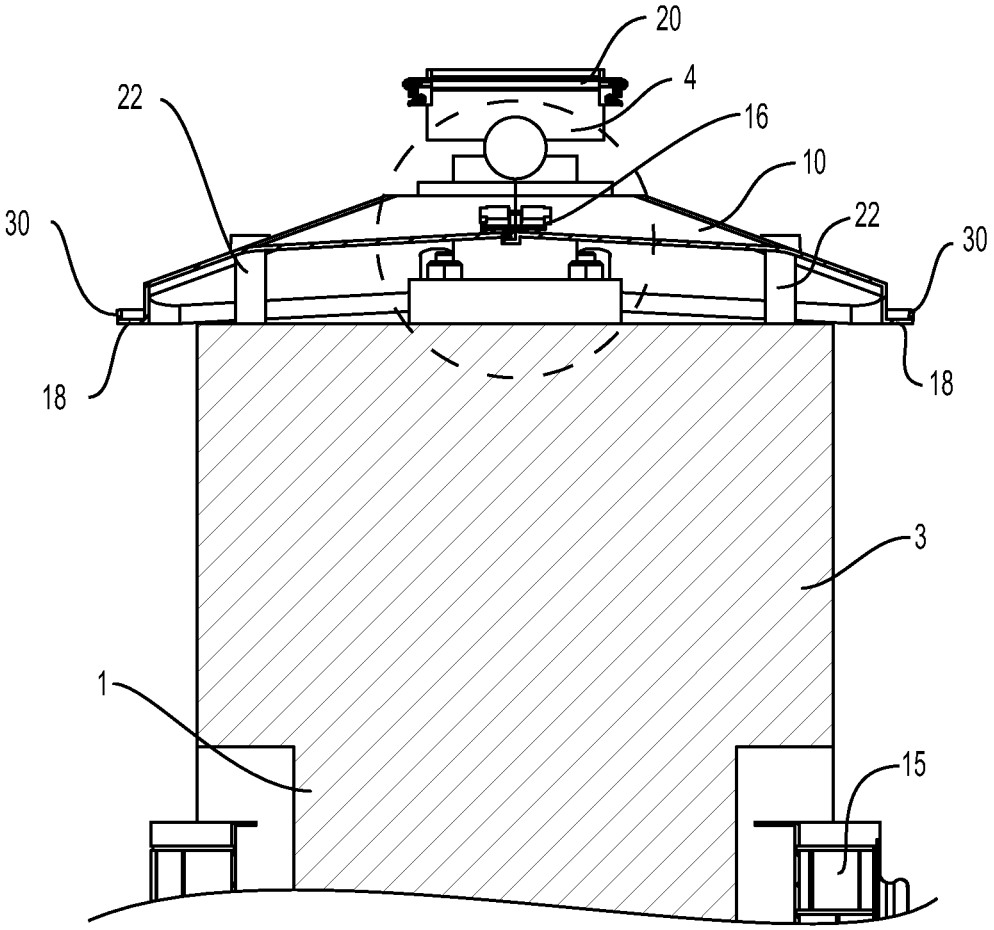
FIG. 7 is a cross sectional view of the top shield along the 7-7 line of FIG. 5.

Although better shown in FIGS. 6 and 7, the outer edges 18 extend outward (horizontally) further than the outer surface of a cover 15 being used to shield the support column 1. As a result, the falling liquid/debris do not contact the outer surface of the cover 15. Of course, if a cover 15 is not used, then the outer edges 18 necessarily extend further than the outer surface of the support column 1. In some embodiments, only the outer edges 18 not having the vertical extending lip 17 extend further than the outer surface of the cover 15 from the center of the support column 1 in the radial direction.

Figure 3:
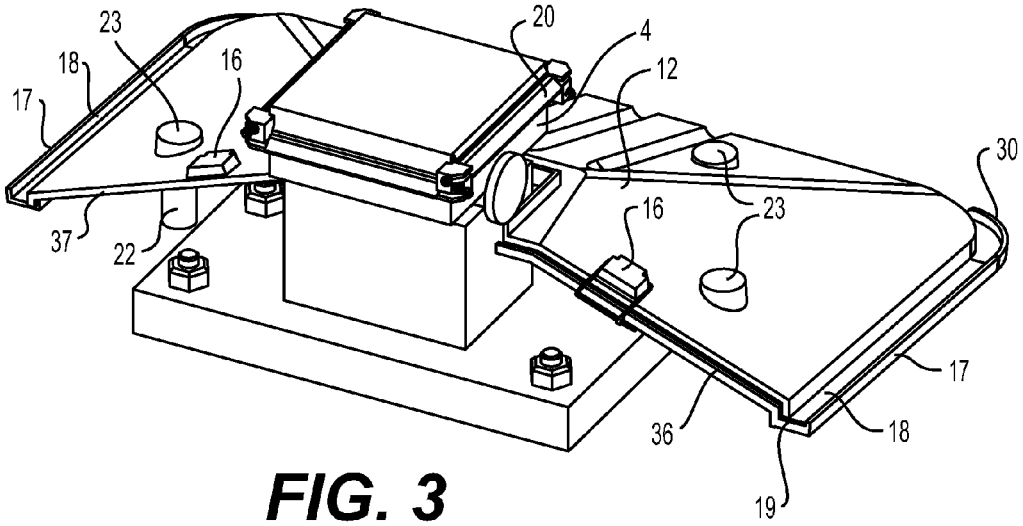
FIG. 3 is a perspective view of a segment of the top shield shown in FIG. 1 according to an embodiment of the present invention.

FIG. 3 is a perspective view of a segment 12 of the top shield shown in FIG. 1 according to an embodiment of the present invention. FIG. 3 shows a shield segment 12 together with a gasket assembly 20. The gasket assemblies 20 are formed on top of the outer surface of the shield segment 12. The gaskets 88 of the gasket assembly 20 make contact with the bearing block 4 surface (or other structure between the support column and road surface) to prevent liquid and debris from passing through the contact portion of the gasket 20 and the outer surface of the bearing block 4.

FIG. 3 additionally shows the tongue and groove connector portions of each shield segment. A tongue edge 37 and a groove edge 36 is shown. The tongue and groove engagement will be described below with respect to FIG. 8. Support members 22 are shown to extend downward from the bottom surface of the shield segment 12. As discussed in more detail below, the support members are inserted into pockets 23 formed into the shield segment 12. In addition, FIG. 3 shows the joining member 16 provided on each side of the segment along the tongue and groove connector 35 edges of the segment 12. Further, FIG. 3 shows that rounded corner vertical lip 30 extends from the side having the vertical edge 17 to the adjacent side (outer edge 18) not having the vertical edge 17.

Figure 4:
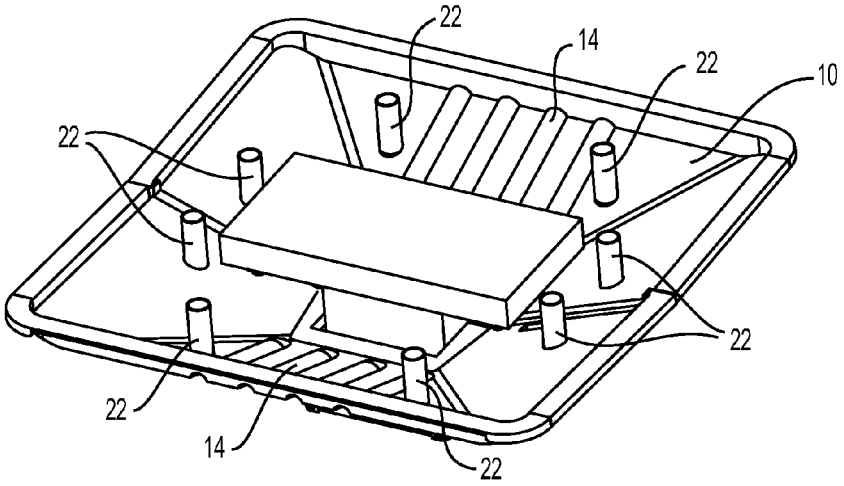
FIG. 4 is a bottom view of the top shield shown in FIG. 1 according to an embodiment of the present invention.

FIG. 4 is a bottom view of the top shield shown in FIG. 1 according to an embodiment of the present invention. FIG. 4 shows the support members 22, which extend downward from the bottom surface of each shield segment 12. The support members 22 support the shield 10 and contact the top surface of the support column 3. The support members 22 may be of a desirable length (e.g., 2 inches) and of desirable shape (e.g., circular cross section or quadrilateral cross section) depending on the position of the bearing block 4 on the support column 1 or the structural features of the top surface of the support column 1. For example, if the top of the support column is not flat and has stepped sections, some support members 22 may be of different lengths so each support member 22 contacts the bearing block 4 or other structure. The pockets 23 may be formed in a shape corresponding to the support members 22 and to accept an end of the support member 22. The support members 22 may be molded into each shield segment 12 or they may be separately manufactured and fitted into pockets 23 formed into the shield segment 12. In such a case, the support members 22 fit in and engage the pockets 23 in a compression fitting. The support members 22 may also be made of polyvinyl chloride (PVC) or other type of plastic. FIG. 4 shows four support members 22 on each shield segment 12, but of course more or less than four could be provided. It is also noted that FIG. 4 shows the channels 14 as grooves in the top surface of each shield segment 12.

The support members 22 raise the shield and provide an air gap between the shield 10 and the top of the support column 3. Other shields may sit directly on top or of the support column or other supporting structures or slightly above the top of the support column or other supporting structures and therefore do not provide for an air gap substantial enough for inspection or for permitting air flow. The air gap provided by support members 22 allow for air to flow between the shield 10 and top of the support column 10. In addition, the air gap allows a person to inspect the top of the support column 1, bearing block 4 and other structural components as well as the shield 10 without needing to remove or dissemble the shield. Accordingly, the shield of the present invention allows for an inspector to easily inspect the support column and other structural components. This is an object of the present invention.

Figure 5:
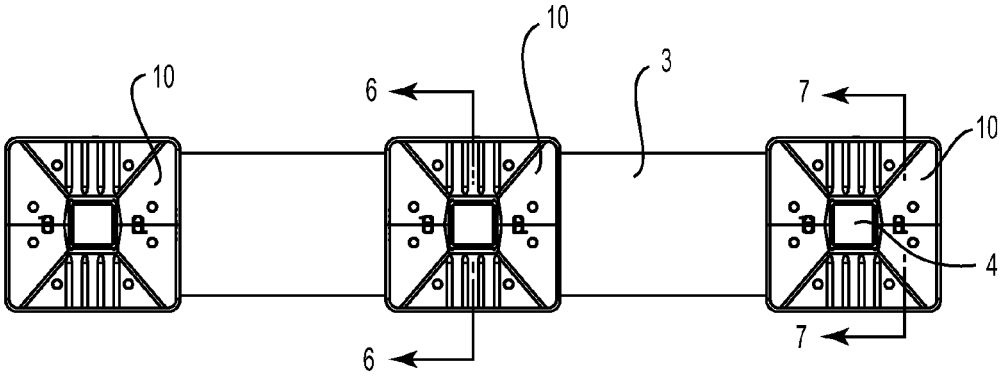
FIG. 5 is a top view of three top shields corresponding to the top shields of FIG. 1 each covering a support column according to an embodiment of the present invention.

FIG. 5 is a top view of three top shields each covering a support column, which are connected by a horizontal member according to an embodiment of the present invention. FIG. 6 is a cross sectional view taken along the line 6-6 of FIG. 5. FIG. 6 shows the support members 22 contacting the top of the support column 3.

The cross section illustrated in FIG. 6 shows the outer edge 18, which does not have a vertical lip 17. As mentioned above, the outer edge 18 is substantially flat and extends horizontally. FIG. 6 additionally shows the tapered edge of the rounded corner vertical lip 30. FIG. 6 also shows that the top surface of the shield 10 is inclined or sloped with the edges around the open center higher than the outer edges 18 in the vertical direction. As mentioned above, the liquid or debris is channeled along a channel formed by the outer edge 18, vertical lip 17, vertical face of shield segment 24 and rounded corner vertical lip 30 to an outer edge 18 that does not have a vertical lip 17. In other words, the graded or sloped structure of the shield 10 along with the structural features described above (e.g., outer edge 18, vertical lip 17, channels 14, and rounded corner vertical lip 30) guides liquid and debris by force of gravity.

FIG. 7 is a cross sectional view of the support column having the top shield taken along the line 7-7 of FIG. 5. FIG. 7 shows the joining member 16, which will be described in more detail below. The dashed lines of FIG. 7 show that the outer edge 18 extends beyond the outer surface of the cover 15 of the support column 1. As a result, liquid or debris falling off outer edge 18 is guided away from the cover so the liquid or debris does not fall onto the surface of the cover 15. The shield although shown to be square and symmetric in drawings does not need to be. For example, the sides running along the horizontal member 3 may be longer or shorter than sides opposite.

Figure 8:
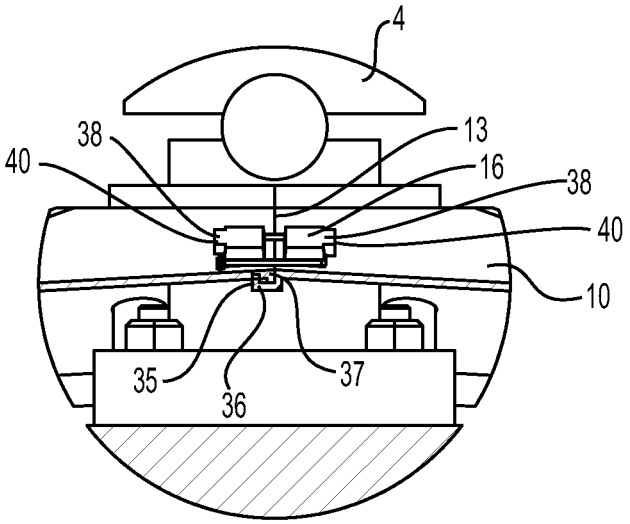
FIG. 8 is a detailed view of the encircled area of FIG. 7 showing a joining member of each segment when the segments are assembled.

FIG. 8 is a detailed view of the encircled area of FIG. 7 showing a joining member 16 of each segment 12 when the segments 12 are assembled to form a shield 10. Note that the view of FIG. 8 shows the bearing block 4 to provide clarity. FIG. 8 shows the joining member 16 of each segment in more detail. As noted above, the shield 10 is formed by joining two shield segments 12 together on top of the support column 1 and around structure elements of the support column (e.g., the bearing block 4). Each shield segment 12 has two protrusions 38, which make up the joining member 16 (see FIG. 2), formed as protruding from the top surface of the shield segment 12. The protrusions 38 are formed to engage with a flexible fastener 39, which may be a zip-type tie. The flexible fastener 39 is placed around each protrusion 38 and fastened to maintain the engagement of the tongue and groove connection 35. The flexible fastener 39 and tongue and groove connection 35 allow for a person to disassemble the shield 10 easier when compared to a shield made of a whole piece (i.e. not in segments) or having permanent fastening means. By removing the flexible fastener 39, the segments 12 may be separated (disjoined along the tongue and groove connector 35) and one segment 12 may be pulled away (for inspection or repair, for example).

The protrusions 38 are shown to be symmetrical, although this is not a requirement. The protrusions 38 also include a tab portion 40 which extends over the top surface of the shield segment 12. The tab 40 creates a slot for the fastener 39 to fit under and prevents the fastener 39 from slipping off the protrusions 38. The fastener 39 is then tightened or fastened to keep the shield segments 12 engaged at the seam 13.

FIG. 8 also shows the tongue and groove connecting edges 35. As shown in FIG. 3, on one side of the inner edge of the shield segment 12, there is a groove edge 36 and on the other side of the inner edge there is a tongue edge 37. When two shield segments 12 are joined/assembled, the corresponding tongue edge 37 of one shield segment 12 engages and fits into the corresponding groove edge 36 of the other shield segment 12. The tongue and groove engagement 35 forms a seam 13. FIG. 8 shows the cross section of the tongue and groove engagement. As shown, the groove edge 36 has a groove for accepting and engaging with the tongue edge 37 having a tongue member. Respective surfaces of the tongue and grooved edges abut and engage each other thereby forming the seam 13 with an appropriate tolerance for accommodating expansion and contraction due to changes in temperature, for example.

Figure 9:
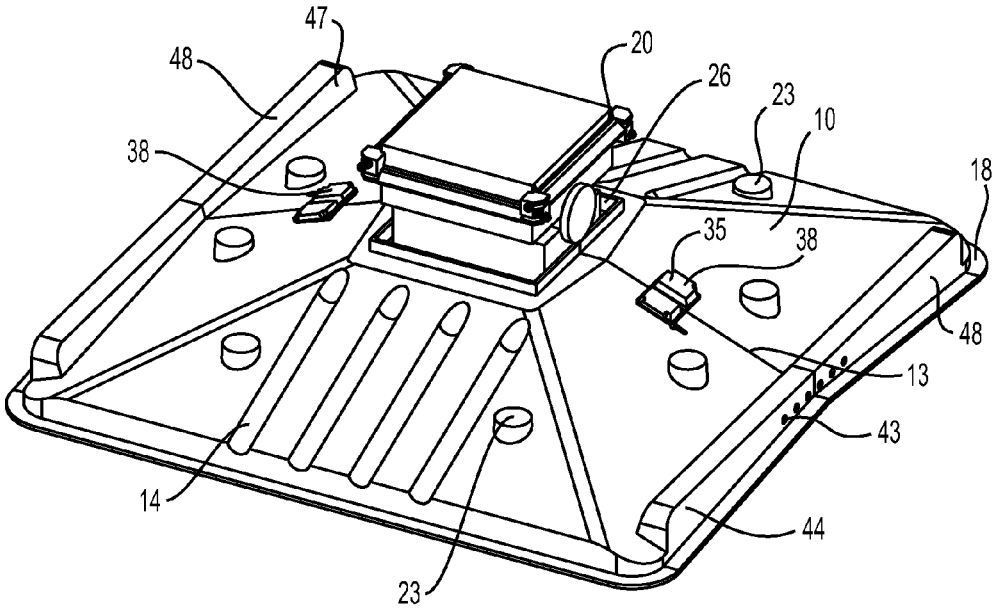
FIG. 9 is a perspective view of a top shield according to an embodiment of the present invention.
Figure 10:
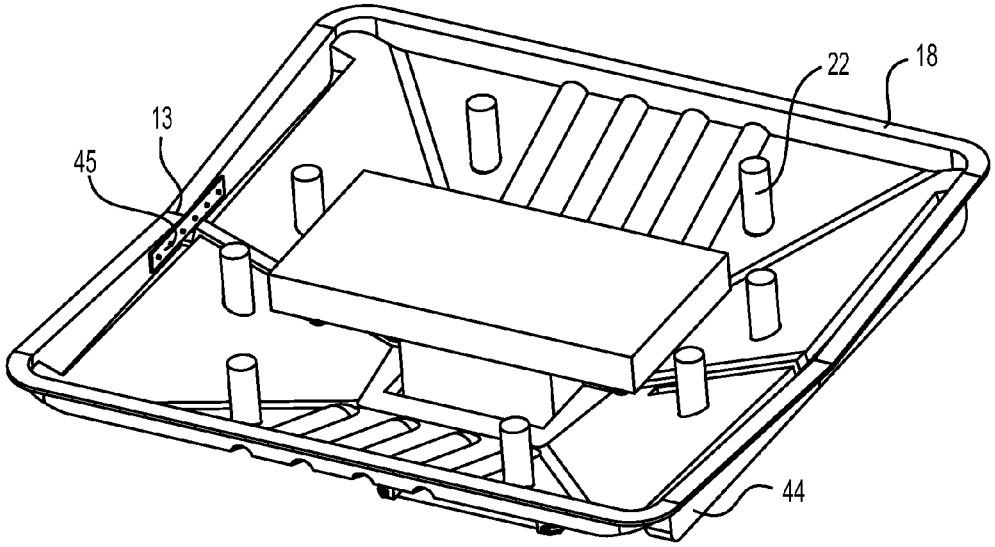
FIG. 10 is a bottom view of the top shield shown in FIG. 9 according to an embodiment of the present invention.
Figure 11:
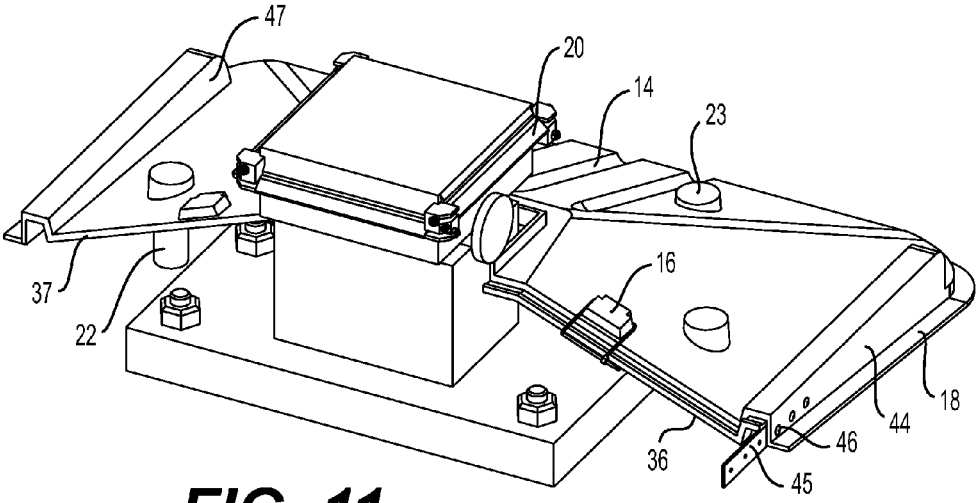
FIG. 11 is a perspective view of a segment of the top shield shown in FIG. 9 according to an embodiment of the present invention.

FIG. 9 is a perspective view of a top shield according to an embodiment of the present invention. The shield shown in FIGS. 9-11 shares similar structural elements and features as that of the shield shown in FIGS. 1-8. One similarity is the segments 12 use a tongue and groove connector 35 to join the two segments 12. The differences between the shields shown in FIGS. 1-8 and the shields shown in FIGS. 9-11 are described below and some elements that are the same are not repeated. For example, the shield shown in FIGS. 9-11 each also have the pockets 23, support members 22, tongue and groove connection 36, 37, respectively, and joining member 16 with flexible fastener 39. Instead of using joining members 16 to maintain the connection between two connected (engaged) shield segments 12, the shield 10 of FIG. 9 employs a connection assembly 48, which may be a bracket 45 using rivets 46 to connect the segments 12. The outside vertical edge 44 of the assembly 48 is formed to extend vertically above the top surface of the shield 10 along the inside outer edge 18 (instead of outside of the outer edge 18, as in the formation of the vertical lip 17) on two sides opposite to each other. As mentioned above, the top surface of each shield segment 12 is graded away from the open center 26 to direct liquid and debris away from the seam 13. As a result, the inside raised vertical edge 47 prevents liquid and debris from flowing onto the outer edge 18 having the raised vertical edge 47,48 and instead the liquid and debris flows to the outer edges 18 not having the raised vertical edge 47,44.

The outside vertical edge 44 of the assembly 48 has holes 43 for accepting a rivet 46 (e.g., screw or the like), which are used to fasten the two segments 12 using a bracket 45 (shown in FIG. 10). As shown, the connection assembly 48 is formed on opposite sides of the shield 10. The connection assembly 48 has a width bound by the outside vertical edge of the assembly 44 and the inside vertical edge of the assembly 47. The width forms a substantially hollow area (or pocket) within the shield segment suitable for a bracket 45 to be placed inside of (as shown in FIG. 10). In addition, the edges 44,47 of the connection assembly 48 extend toward a corner, away from the seam 13 along the outer edge 18. In one embodiment, the edges 44,47 of the connection assembly 48 do not wrap around corner, rather the edges 44,47 taper off before the corner, as shown in FIG. 9. In the alternative, the edges 44, 47 extend to wrap around the corner.

The top surface of the shield segments 12 are drafted away from the open center 26. In addition, top surface of the shield segments 12 are drafted away from the seam 13 to direct liquid and debris away from the edges of the segments 12 constituting the tongue and groove connections 35.

FIG. 10 is a bottom view of the top shield shown in FIG. 9 according to an embodiment of the present invention. As shown in FIG. 10, when two shield segments 12 are joined, a tongue and groove engagement 35 is established, as discussed above. Further, a bracket 45 is provided on the underside of the shield 10, which traverses the seam 13 on the underside of the shield 10 in the pocket formed by the connection assembly 48. The bracket 45 may be fastened using a rivet 46 (i.e., pin, bolt, screw, or the like). FIG. 9 shows may be used to fasten the bracket 45 of the connection assembly 48 thereby securing the two shield segments 12 in a fixed joined state.

FIG. 11 is a perspective view of a segment of the top shield shown in FIG. 9 according to an embodiment of the present invention. FIG. 11 shows the bracket 45 within the pocket formed by the connection assembly 48 on the underside of the shield 10. FIG. 11 shows the tongue 37 and groove 36 edges formed along the seam 13 of each segment 12.

Figure 12:
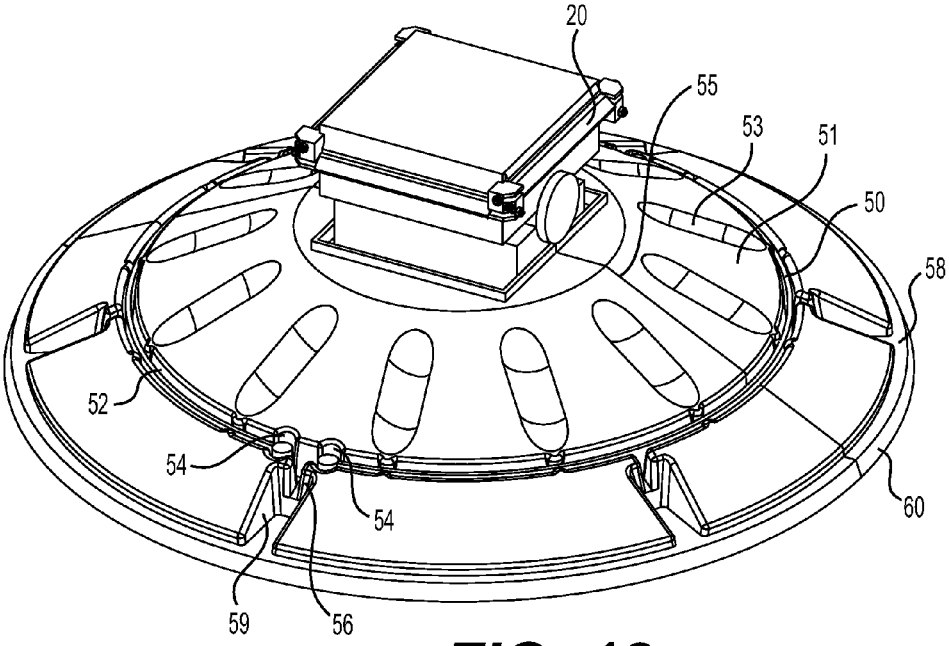
FIG. 12 is a perspective view of the top shield according to an embodiment of the present invention.

FIG. 12 is a perspective view of a top shield according to an embodiment of the present invention. The shape of the outer perimeter of the shield 51 shown in FIG. 12 is circular or rounded rather than quadrilateral. As mentioned, the shield 51 has an open center 26 which may be quadrilateral or rounded in shape. The shield 51 shown in FIG. 12 additionally includes the gasket assembly 20, which is explained in greater detail below. The outer edge 58 around the shield 51 shown in FIG. 12 extends beyond the outer surface of the support column cover 15 (similarly to other embodiments explained above). The shield 51 is made of two segments 12, which when assembled to form the shield 10, the two segments join together at the seam 55. Rather than providing protrusions 38 with a fastener 39 used to secure the two segments in an assembled state, the segments 12 of the shield of FIG. 12 are joined by a rounded substantially semicircular collar 52 (shown in FIG. 14).

In addition, the top surface of the shield of FIG. 12 is drafted away from the center to allow liquid and particles to fall off the shield 51. Further, radial channels 53 are provided to guide the liquid and debris and are shaped as grooves in the top surface of the shield segments. The shield of FIG. 12 also has an outer annular channel 50, which the collar 52 is placed into. The heads 64 of each collar 52 (see FIG. 14) fit into slots 54 formed into the top surface of the shield 51 and the outer channel 50. The slots 54 have a shape corresponding to the heads 64 to accept the heads 64. The heads 64 form a mechanical or compression fitting into the slots 54 upon assembly of the shield segments 12. The pair of slots 54 are located opposite each other and one slot 54 of the pair is for fitting the head 64 of one collar 52 and the other slot 54 of the pair is for fitting the head 64 of the other collar 52. Further, the slots 54 are shown to be essentially 90 degrees away from the seam 55 around the shield 51, but this is not a limitation or requirement.

Located at intervals are passages 56, which are indentations formed into the top surface of the shield 51. The passages 56 allow liquid/debris to flow from the outer annular channel 50 through the passages 56 to the outer edge 58 located below. The bottom surface of the outer annular channel 50 and the bottom surface of the passage 56 are aligned so as to allow the passage of liquid/debris. As shown, the outer edge 58 is an annular stepped down edge formed around the perimeter of the shield 51. Around the outer edge 58 and extending in a downward vertical direction is a vertical edge 60. The vertical edge 60 is formed at an angle with respect to the outer edge 58 and may be less than 90 degrees (perpendicular to the outer edge 58). As shown in FIG. 12, the passages 56 are formed in intervals around the shield, but the passages 56 do not necessarily need to formed at intervals. Also, fewer or more passages 56 may be formed into the top surface of the shield. In addition, a well 59 is formed at each passage 56 to accept liquid and debris from the passage 56. The bottom of the well 59 is flush with the outer edge 58.

As a result of the structure shown in FIG. 12 and explained above, liquid/debris may flow from the top surface of the shield 51 near the center down the radial channels 53 into the outer annular channel 50 through the passage 56 into the well 59 onto the outer edge 58 and off the vertical edge 60 (to the ground below). In some embodiments, the shield 51 extends beyond the outer surface of the support column 1 or cover 15 of the support column 1 so that falling liquid or debris does not contact the outer surface of the support column 1 or cover 15 of the support column 1.

Figure 13:
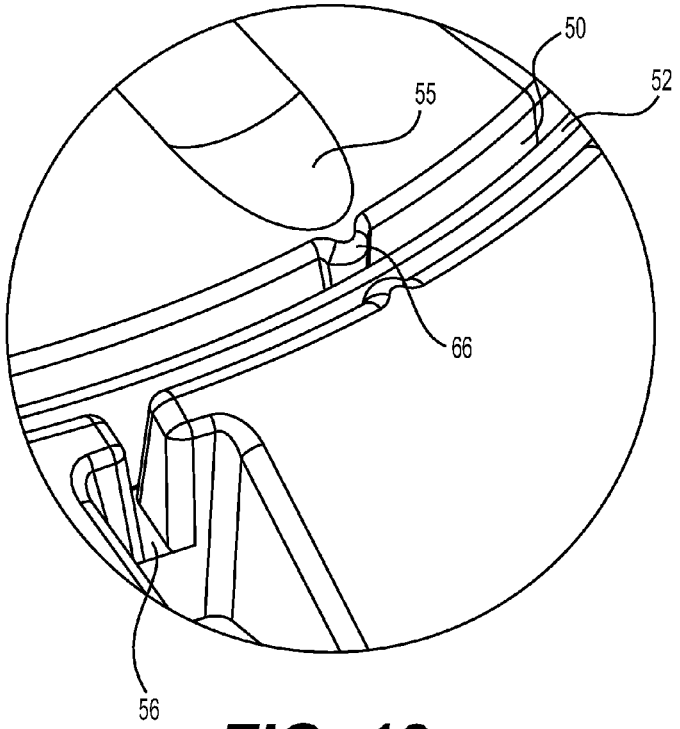
FIG. 13 is a detailed view of the encircled region of FIG. 12 showing the bumps, passage, and outer annular channel according to an embodiment of the present invention.

FIG. 13 is a detailed view of the encircled region of FIG. 12 showing the bumps, passage, and outer annular channel according to an embodiment of the present invention. FIG. 13 shows bumps 66 are formed extending inward toward the outer annular channel 50 to contact and engage with the collar 52. The collar 52 engages the bumps 66 for compression fitting to keep the collar 52 in place once the shield 51 is constructed. A pair of bumps 66 is shown to be formed in the outer annular channel 50 at each radial channel 53, however, the bumps 66 do not need to be formed at each radial channel 53; the bumps 66 may be formed in different locations that keep the collar 52 in place.

Further and as mentioned above, FIG. 13 shows that the bottom of the passage 56 is flush and aligns with the outer annular channel 50. The bottom of the passage 56 may also be included or graded to promote the flow of liquid/debris.

Figure 14:
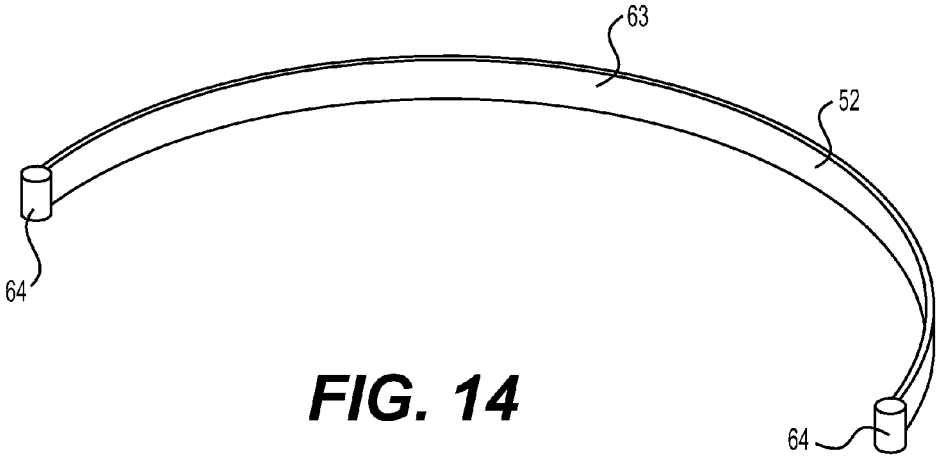
FIG. 14 is a collar used to connect top shield segments according to an embodiment of the present invention.

FIG. 14 is a collar used to connect top shield segments according to an embodiment of the present invention. In an embodiment the collar 52 is made of rust resistant metal (e.g., aluminum). The collar 52 can be any length suitable for securing the connection of the shield segments. Of course, the position of the slots 54 depends on the length of the collars 52. The shape of the collar 52 is generally round to fit into the outer channel 50. As shown, the collar 52 is a semicircular shape, since two are used to secure the shield 51. As mentioned above, the collar 52 fits into the outer annular channel 50 and the body of the collar 63 engages with bumps 66, while the heads of the collar 64 fit into and engage with the slots 54.

Figure 15:
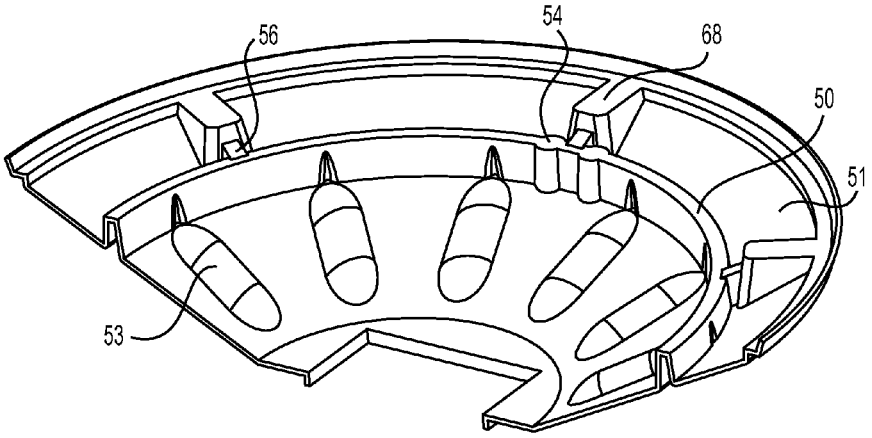
FIG. 15 is a bottom view of a segment of the top shield shown in FIG. 12 according to an embodiment of the present invention.

FIG. 15 is a bottom view of a segment of the top shield shown in FIG. 12 according to an embodiment of the present invention. FIG. 15 shows the outer annular channel 50, radial channels 53, passages 56, and wells 59 formed into the surface of the shield 51. In addition, the bottom side of the well 59 contacts the bearing block 4 (or other structure on top of the support column 1). The contact 68 area of the well 59 supports the shield 51 on the top of the support column (or block bearing 4, as the case may be).

The contact areas 68 enable the top surface of the shield to sit above the top of the support column and provide an air gap between the shield 10 and the top of the support column 10. The air gap allows for air to flow between the shield 10 and top of the support column 10. In addition, the air gap allows a person to inspect the top of the support column 1, bearing block 4 and other structural components as well as the shield 10 without needing to remove or dissemble the shield. Accordingly, the shield of the present invention allows for an inspector to easily inspect the support column and other structural components. This is an object of the present invention.

Figure 16:
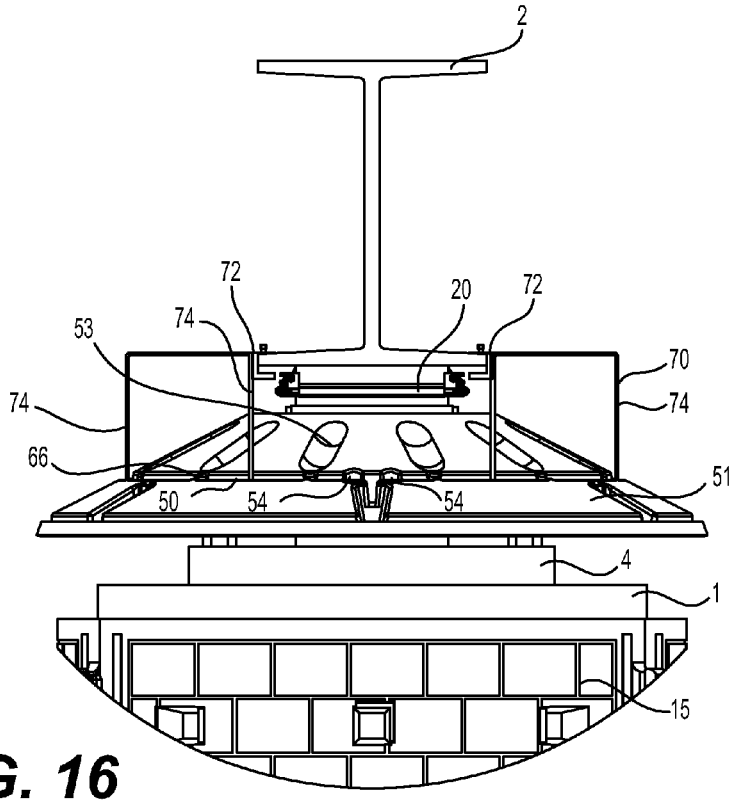
FIG. 16 is a perspective view of the top shield of FIG. 12 using a beam support collar according to an embodiment of the present invention.
Figure 17:
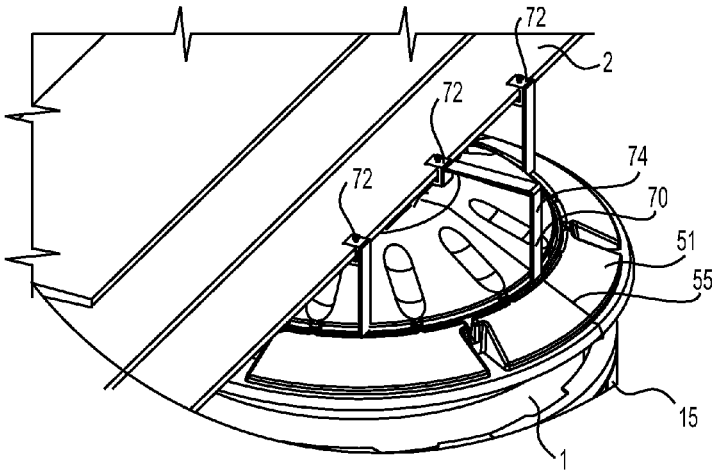
FIG. 17 is a perspective view of the top shield of FIG. 12 using a beam support collar according to an embodiment of the present invention.

FIG. 16 is a perspective view of the top shield of FIG. 12 using a beam support collar according to an embodiment of the present invention. FIG. 17 is another perspective view of the top shield of FIG. 12 using a beam support collar 70 according to an embodiment of the present invention. The round top shield 51 according to an embodiment of the present invention as shown in FIGS. 16 and 17 is similar to the shield shown in FIG. 12. In some practical applications of embodiments of the present invention, the structure(s) on top of the support column 1 (e.g., pier cap, bearing block 4) are too large for a top shield of other embodiments to be practically installed onto the top of the support column 1. In such cases, the shield 51 of the FIGS. 16 and 17 may be installed with a beam support collar having collar 70 extensions 74 that attach to a support beam using mechanical attachments 72, such as a screw clamp.

Similar to embodiments described above the shield uses gaskets 88 of gasket assembly 20 and the outer edge of the shield 51 extends beyond the outer surface of the support column 1, whether having a cover 15 or not, as shown by the dashed lines in FIG. 16. The support column 1 is shown to have a cover 15 in FIG. 16. In addition, the heads 64 of the beam support collar 70 fit into slots 54 to secure the shield 51 once installed and uses bumps 66 at one end of each channel 50 to provide a mechanical engagement of the body of the beam support collar 70 in the outer annular channel 50, such as compression fit or friction fit. It is noted that there are many similarities between the structure of the shield shown in FIGS. 16 and 17, but only some are noted above.

Figure 18:
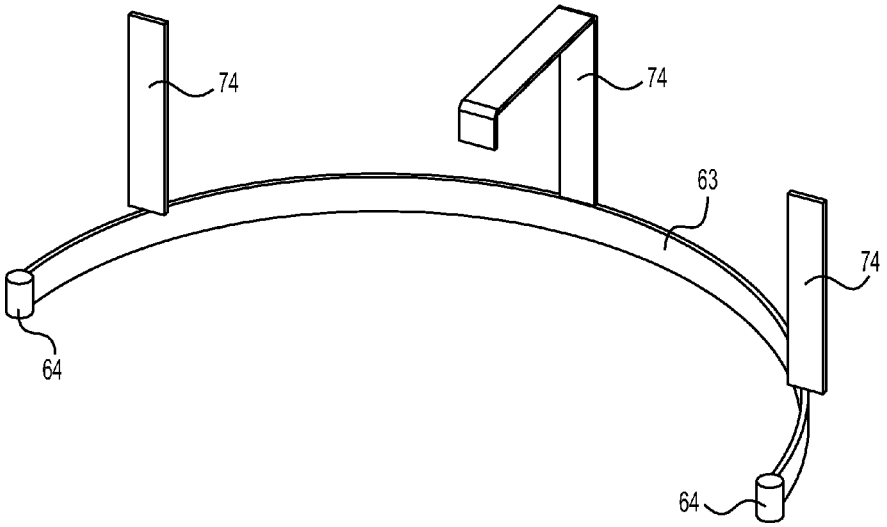
FIG. 18 is a perspective view of a beam support collar used to connect shield segments and suspend the shield from a structure according to an embodiment of the present invention.

FIG. 18 is a perspective view of a beam support collar used to connect shield segments and suspend the shield from a structure according to an embodiment of the present invention. The beam support collar 70 shown in FIG. 18 is shown without the mechanical attachments 72 used to attach the collar to the I beam 2. The mechanical attachments 72 may be a clamp or screw type fitting to attach to the I beam 2. FIG. 18 shows there are three collar extensions 74, however, the number of collar extensions 74 may be more or less. The mechanical attachments 72 are provided at the I-beam 2 side of the collar extensions 74.

Figure 19:
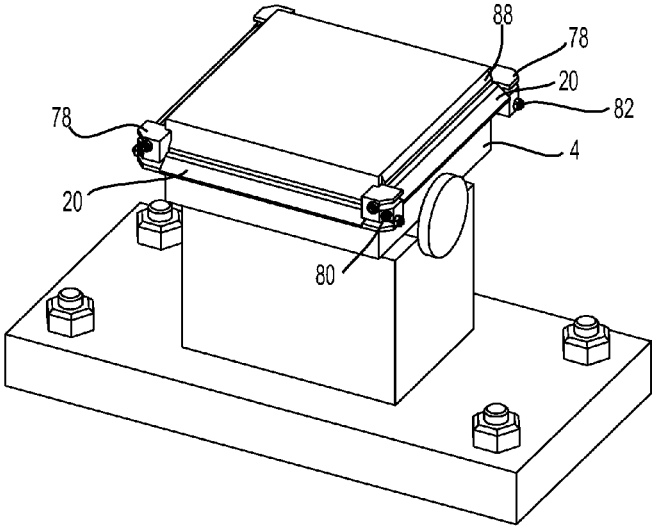
FIG. 19 is a perspective view of the gasket assembly assembled around a bearing block of a support column according to an embodiment of the present invention.

FIG. 19 is a perspective view of the gasket assembly assembled around a bearing block 4 of a support column according to an embodiment of the present invention. The gasket assembly may be installed separately from the shields 10. Typically, the gasket assembly 20 is installed above the shield 10 and below the support beam (I-beam) 2. The gasket assembly 20 includes corner assemblies 78, which are provided on each corner of the bearing block 4. Of course, if the bearing block 4 is not rectangular in shape, it may contain fewer or more corners and therefore a corresponding number of corner assemblies can be assembled for the gasket assembly 20. In general, one or more rods 76 each support a gasket between the corner assemblies 78.

In addition, the upper edge of each gasket (angled edge) 85 may be tapered along the surface that contacts the bearing block 4. As a result of the tapering, the thickness of the upper edge 85 may be thinner than the thickness near the lower edge 87. In other words, liquid and debris are prevented from dripping down the outer surface of the bearing block 4 on top support column 1 through the gaskets 88. Rather, the gasket 88 wicks the liquid down and away from the outer surface (e.g., concrete) of the bearing block 4. As mentioned above, the gaskets 88 may be biased toward the bearing block 4 to apply pressure to ensure contact and therefore create a seal by a spring or other tension member, for example (not shown). Further, FIG. 3 shows two gaskets 20 arranged on adjacent sides of the shield segment 12.

The shield 10 has an open quadrilateral center. The gasket assembly 20 is attached around the open quadrilateral center 26 and the upper angled edge of the gasket 85 contacts the bearing block 4 to form a seal preventing liquid and debris from falling between the bearing block 4 and the shield 10.

The gasket 88 may be formed of plastic or rubber or any other material capable of forming a seal against the bearing block 4. As mentioned above, the gasket 88 may consist of a blade of flexible material that fits snugly around the vertical sidewall of the bearing or undersurface of the beam without the use of an adhesive, although this is not a limitation. In one example, the flexible material is applied under slight compression to keep solutions from infiltrating the bearing assembly while allowing for mobility (e.g., thermal expansion and contraction) of the bearing.

Figure 20:
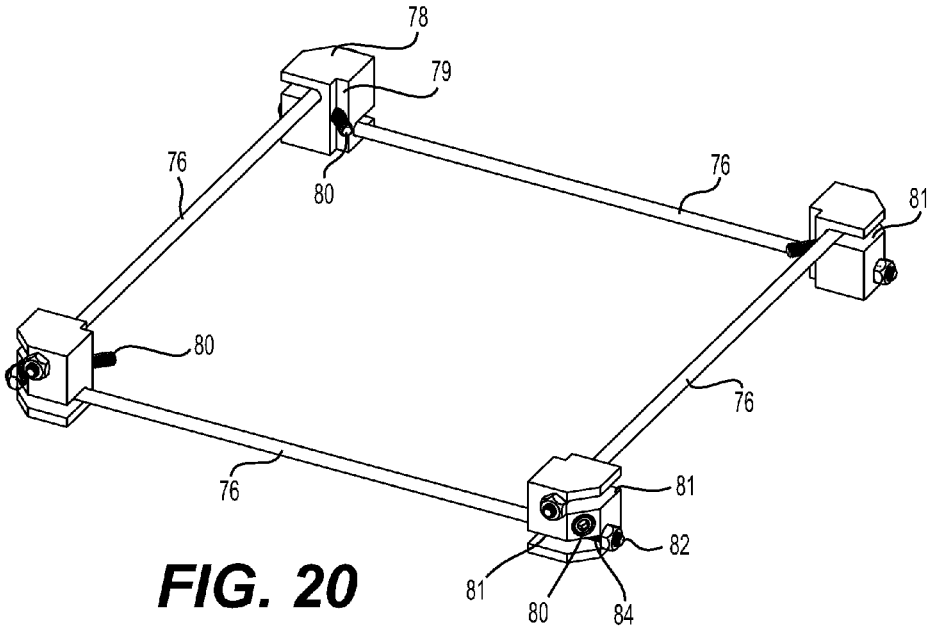
FIG. 20 is a perspective view of a gasket assembly according to an embodiment of the present invention.

FIG. 20 is perspective view of a gasket assembly according to an embodiment of the present invention. FIG. 20 shows each corner assembly 78 has a notch 79 which conforms to the outer corner of the bearing block 4. FIG. 20 shows the notch 79 is squared (at a right angle), however, the notch may be formed of any shape that conforms to the shape of the outer corner of the bearing block 4 to which it is being assembled. A rivet (e.g., screw or bolt) is used to attach each corner assembly 78 to the bearing block. As shown in the rivet 80 penetrates through the corner assembly into the bearing block 4 (the actual penetration of the rivet into the bearing block 4 is not shown). Each corner assembly also has one or more slots 81 for accepting respective ends of the rods 76. The rods are threaded at both ends to accept a nut 82 to secure the rod in place once each end of the rod is assembled into each respective slot of each corner assembly. The rods may be made of plastic or metal. The rods are preferably rust resistant.

Figure 21:
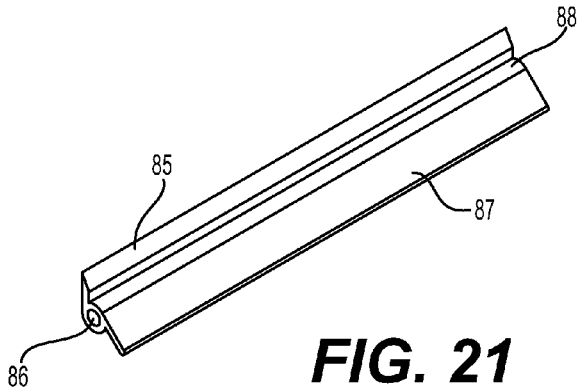
FIG. 21 is a perspective view of a gasket according to an embodiment of the present invention.

FIG. 21 is a perspective view of a gasket according to an embodiment of the present invention. The gasket 88 has a hollow center 86 to accept the rod 76. As mentioned above, the rod 76 slides through the opening of the hollow center 86 to support the gasket 88 on the rod. The gasket has an angled edge 85, which contacts the outer edge of the bearing block 4 to wick away moisture and debris. The angled edge has characteristics similar to a wiper blade on a car windshield. As shown, another edge 87 extends from the rod along the length of the gasket.

Figure 22:
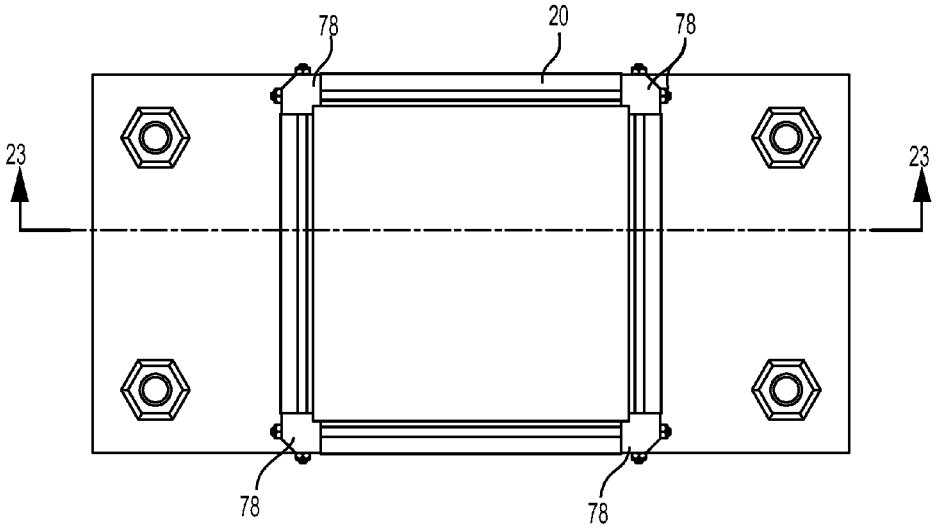
FIG. 22 is a top view of a gasket assembly according to an embodiment of the present invention.
Figure 23:
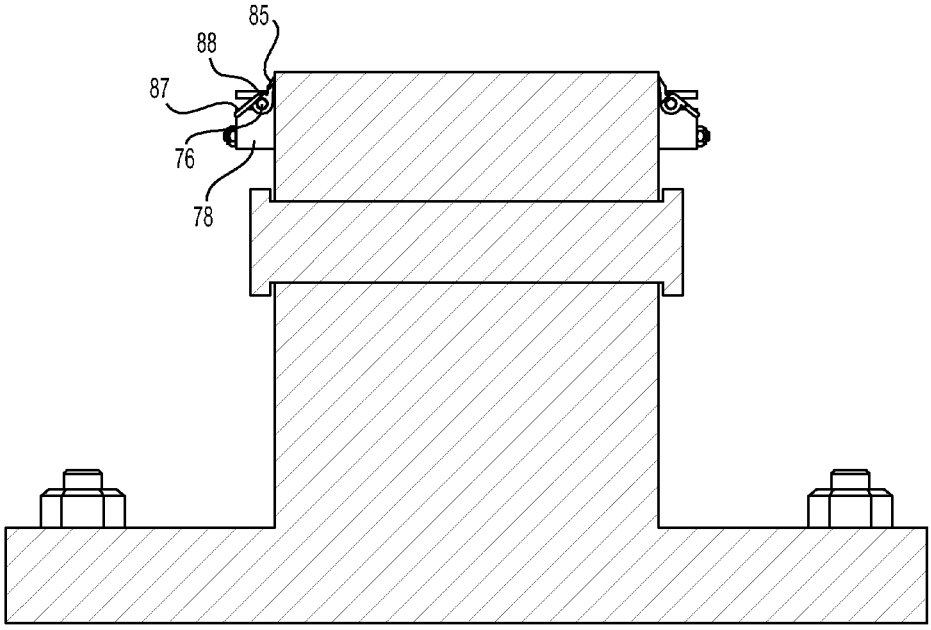
FIG. 23 is a cross sectional view taken along the line 23-23 of FIG. 22.

FIG. 22 is a top view of a gasket assembly according to an embodiment of the present invention. FIG. 23 is a cross section taken along the line 23-23 of FIG. 22. FIG. 23 shows the gasket 88 having angled edge 85 and edge 87 extending away from the rod 76. The angled portion of the edge is shown to face up, rather than down toward the bearing block 4.

Figure 24:
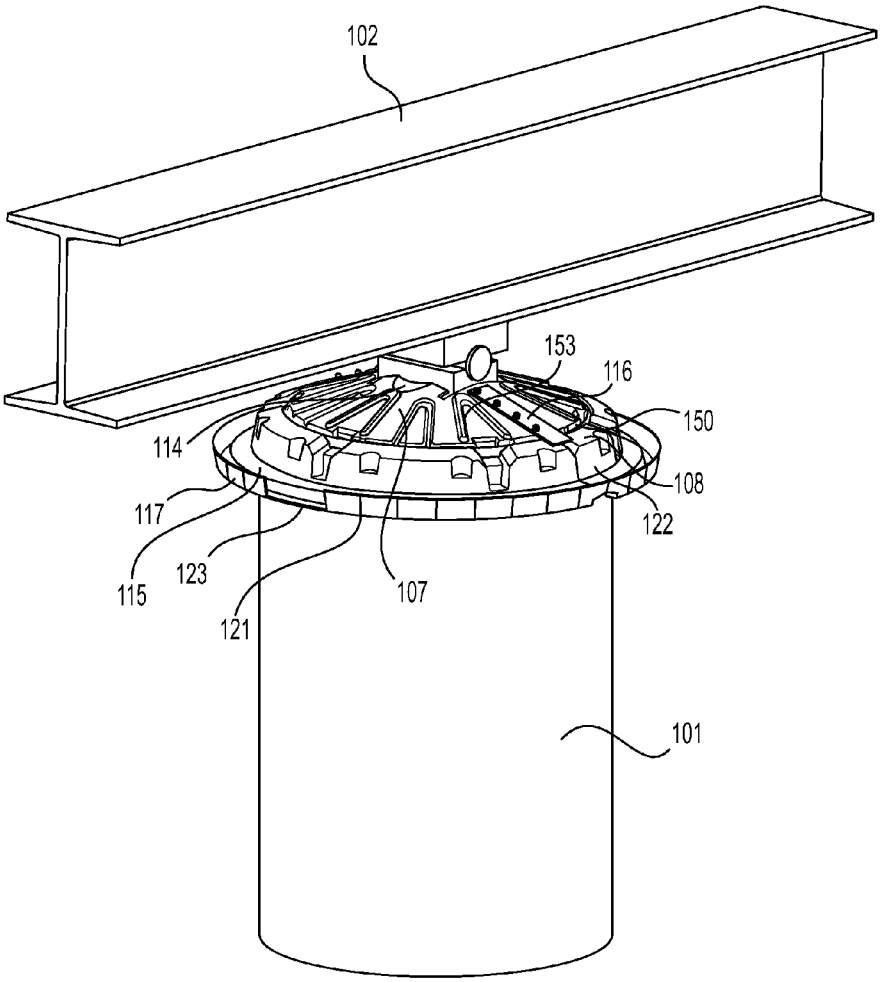
FIG. 24 is a perspective view of shield segments connected to form a shield on top of a support column and around a bearing block according to an embodiment of the present invention.

FIG. 24 is a perspective view of shield segments 112 connected to form a shield 110 on top of a support column 101 and around a bearing block according to an embodiment of the present invention. The top shield 110, like the shield 10 described above, has a round shape (e.g., FIG. 12). FIG. 24 shows a top shield 110, which is two shield segments 112 connected together. The support column 101 and other parts of the support structure are described as being made of concrete or having an outer layer of concrete. But, this is merely an example of the application of the shield 110. The top shield 110 may be applied to structures other than support structures and the structures may be composed of materials other than concrete. The top of the support column 110 is shown to include a bearing block 104. Bearing blocks and other associated hardware are of various shapes and sizes. The shape of the center portion of the shield 110 may be configured to accommodate any shape or size of the bearing block which it surrounds. In other words, the shield 110 may be formed to correspond to many shapes or structures of the bearing block 104 and is not limited to what is shown.

Like the shields described above and as is apparent in the following figures and descriptions, the shield 110 may be composed of two shield segments 112 joined together at a seam 113. Throughout the following description, the shield 110 is described as being in two segments 112, which are joined/connected together to form the shield 110. However, the shield 110 may formed of more than two segments 112 without departing from the spirit of the invention. Forming the shield in two segments 112 allows for ease of installation (assembly) and removal (disassembly). Further, a seam 113 may refer to the edge or side of a respective shield segment 112 or a where shield segments 112 contact or abut each other when they are connected or assembled. The segmented design also allows for repairs to the structure (e.g., support column, bearing block etc.) to be conducted easily since only a segment of the shield needs to be removed to uncover an area that needs to be repaired or further inspected. The top shield 110 may also be configured to include the gasket assembly described above.

As mentioned above, it is an object of the present invention to provide a shield 110 that prevents liquid (e.g., rain water, solution) and other particulate (e.g., debris) from falling onto the surface of the support column 101 or the bearing block 104. In particular, the structure of the shield 110 is formed such that liquid and debris that falls onto the shield is directed away from the center of the shield and onto the ground below without contacting the surface of the support structure. The liquid and debris are guided off the sides of a shield through a slot or cut out 123 formed in the vertical lip 117. The shield 110, when formed by connecting two or more shield segments 112, may essentially have a conical shape or a dome-type shape. Such that a center portion is higher in the vertical direction than the outer perimeter of the top shield 110.

The top shield in FIG. 24 shows two cover segments which may be connected with a bracket assembly 116. As shown, the outer most vertical lip 117 has notches or guidelines 121 which may guide installation personnel to cut or otherwise form a cutout or slot 123 in the vertical extending lip 117. The notches or guidelines 121 may be formed every 10 degrees around the shield segment 112 (i.e., vertical lip 117), for example. The guidelines 121 may be impressions and may be a thinner thickness than the thickness of the vertical lip 117 not including a guideline 121 to allow for removal of a portion of the vertical lip 117 between two guidelines 121 to from a slot 123. The cutout or slots 123 may not be formed until the point of installation. The cutouts or slots 123 allow for the installation personnel to configure where the exit for liquid or debris falling onto the shield 110 may be. Until the slots 123 are formed, the vertical lip 117 is a continuous barrier or wall. The shield segments 112 are also pitched (i.e., sloped, graded, or drafted) to bias liquid or debris away from the center and allow the liquid or debris to fall away using gravity through the slots 123 in the vertical lip 117. For example, the top main surface 107, intermediate main surface 108, and outer main surface are sloped or angled downward away from the center of the shield segment 112. Additionally, the outer edge 118 may be formed lower in the vertical direction than the outer main surface 115, which may be formed lower in the vertical direction than the intermediate surface 108, which may be formed lower in the vertical direction than the top main surface 107. The top main surface 107, intermediate surface 108, and outer main surface of each cover segment 112 may also be drafted (i.e., angled) away from the seam 113.

Although apparent in the Figs., the top main surface 107, intermediate main surface 108, outer main surface 115 refer to surfaces of the cover segment that essentially face upward toward the I-beam 102. Between the top main surface 107 and the intermediate main surface 108 in the radial direction a collar channel 150 is provided, which will be described in more detail below. An intermediate face 122, which faces outward and spans in the vertical direction, may be formed at an oblique angle (angle other than 90°) or at a right angle with respect to the intermediate main surface 108. The outer main surface 115 may be formed at an oblique angle or at a right angle with respect to the intermediate face 122. As better shown in FIG. 26, the outer face 125, which faces outward and spans in the vertical direction, may be formed at an oblique angle or at a right angle with respect to the outer main surface 115. Further, the outer edge 118 may be formed at an oblique angle or a right angle with respect to the outer face 125 and the vertical lip 117 may be formed at an oblique angle or right angle with respect to the outer edge 118. The outer edge 118 extends outward and away from the center of the shield segment 112 and the vertical lip extends substantially vertical.

The top main surface 107 may have the widest width in the radial direction among the intermediate main surface 108, outer main surface 115, and outer edge 108. A Width of the top main surface 107 in the radial direction may be 15.25". A width of the collar channel 150 in the radial direction may be 0.29". A width of collar 152 may be 0.25". A width of the intermediate main surface 108 in the radial direction may be 2.9". A width of outer edge 118 in the radial direction may be 1". Additionally, a height of the vertical lip 117 may be 2".

Figure 25:
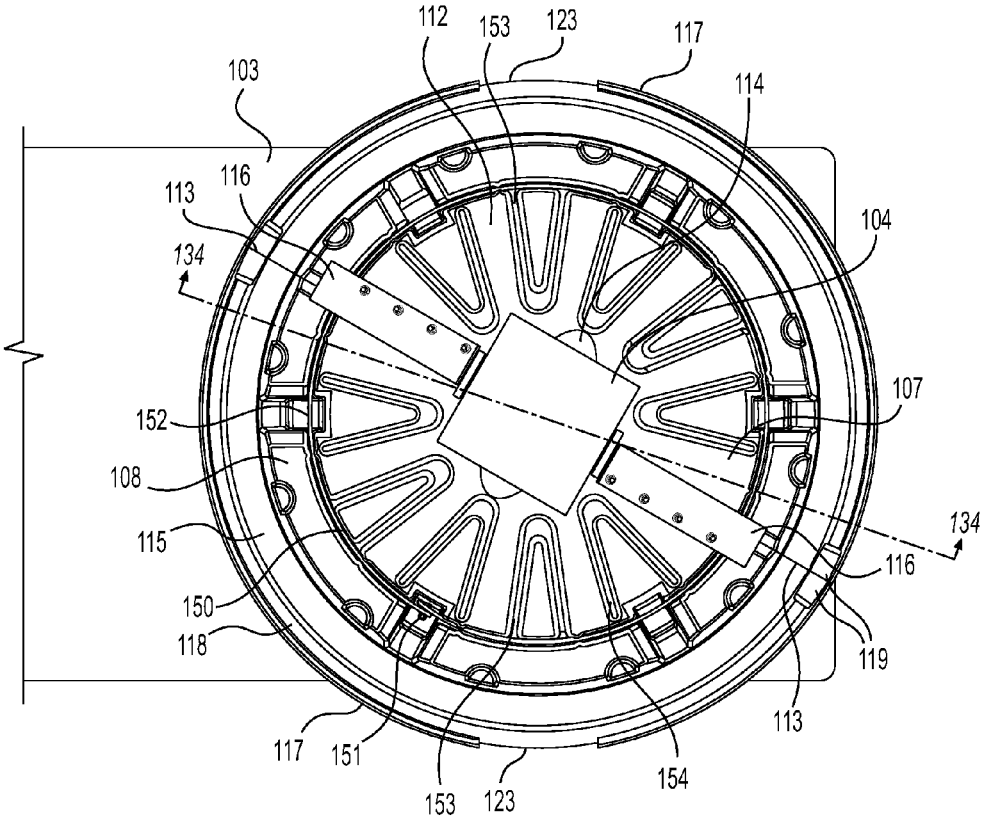
FIG. 25 is a top view of a shield according to an embodiment of the present invention.

FIG. 25 is a top view of a shield according to an embodiment of the present invention. FIG. 25 shows an assembled shield 110 of two shield segments 112 around a bearing block 104. The shield 110 in FIG. 25 is shown above a horizontal member 103, which may be made of concrete. As shown, the slots 123 in the vertical lip 117 are formed in a portion of the vertical lip 117 that is not above or over the horizontal member 103 in the vertical direction. This allows the liquid or debris to fall off the shield 110 away from the horizontal member 103. FIG. 25 shows two slots opposite to each other; however, there may be fewer or more than two slots and the slots do not need to be opposite to each other.

The top view of FIG. 25 further shows radial channels 153 and radial ribs 154 disposed in the top main surface 107 of the shield segments 112. The top main surface 107 of each shield segment 112 is the top surface closest to the center of the shield and each of the intermediate main surface 108, outer main surface 115, and outer edge 118 may be formed concentrically in each semi-circular shield segment 112. The radial channels 153 may be grooves, channels, or concave depressions in the top main surface 107, for example, that allow for liquid or debris to be channeled in the collar channel 150, which will be described in more detail below. The lower end of each radial channel 153 in the vertical direction has a spout or opening into the collar channel 150. The radial channels 153 provide structure and support for the cover segments 112. There may be one or more radial channels 153 formed and the channels may be spaced apart evenly around the top main surface 107.

One or more radial ribs 154 may be formed in the top main surface 107 of the cover segment 112. The radial ribs 154 also provide structure and support for the cover segments 112. The radial ribs 154 may be convex protrusions protruding out from the top main surface 107 and may be spaced apart evenly around the top main surface 107.

Figure 26:
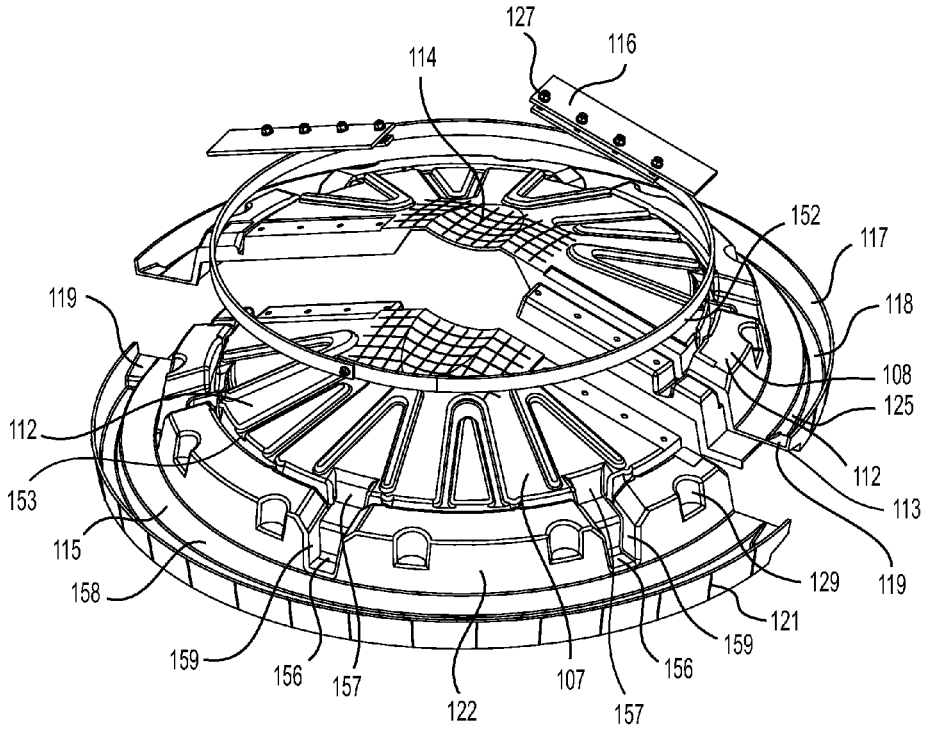
FIG. 26 is a perspective view of two shield segments, a collar, and a bracket assembly used to connect two cover segments according to an embodiment of the present invention.

FIG. 26 is a perspective view of two shield segments 112, a collar 152, and a bracket assembly 116 used to connect two cover segments 112 according to an embodiment of the present invention. In FIG. 26, two cover segments 112 with a collar 152 and the bracket assembly 116, which both may be used to connect and fasten the shield 110, when the two cover segments 112 are connected. Each of the collar 152 and the bracket assembly 116 will be explained in more detail below.

As mentioned, between the intermediate main surface 108 and the top main surface 107, a collar channel 150 may be disposed in the top surface of the shield segment 112. The width of the collar channel 150 in the radial direction should be wide enough for a collar 150 to be placed into and may not be wider than necessary for harboring or engaging the collar 150. Further, the necessary depth of the collar channel 150 in the vertical direction is a depth sufficient to harbor the collar channel 150 so that a top surface of the collar channel 150 does not breach a plane of the top main surface 107 or intermediate surface 108.

Near the seams 113 of a shield segment 112, the outer edge 118 may include an angled portion 119. At angled portion 119 of the outer edge 118, the outer edge 118 rises to form a slope or angled surface at an oblique angle with respect to outer edge 118 to direct liquid or debris within the channel formed by the outer edge 118, vertical lip 117, and outer face 125 away from the seam 113.

FIG. 26 further shows depressions or indentations 129 that may be formed in the intersection of the edges of the structure of the intermediate main surface 108 and intermediate face 122. As will be explained with reference to FIG. 37, the depressions 129 provide for nested stacking of multiple shield segments 112. One or more of the depressions 129 may be formed and they may be spaced apart in the intermediate main surface 108 and intermediate face 122 according to regular intervals. Further shown are stepped passages 159 which may be formed into the top main surface 107, intermediate main surface 108 and intermediate face 122. One or more stepped passages 159 may be formed and may be spaced apart according to a regular interval.

A stepped passage 159 may be an indentation or recess having stepped surfaces formed into at least one of the main surface 107, intermediate main surface 108, collar channel 150, and intermediate face 122. The stepped passage 159 allows liquid and debris to flow off the top main surface 107, through the collar channel 150, and continue through the intermediate top surface 108 and intermediate face 122 onto the outer main surface 115. Two steps are shown facing upward and having corresponding outward facing vertical faces.

For example, a top portion of a stepped passage 157 may be formed in the top main surface 107 of each shield segment 112 between radial ribs 154. The top portion of a stepped passage 157 is a concave depression formed into the top main surface 107 and the face that extends vertically downward from the top main surface 107. The stepped passage has a top step which may be angled to allow liquid or debris to flow down through the collar channel 152. The top step may also be flush with the collar channel 150. Another concave portion of the stepped passage 159 may be formed into the intermediate main surface 108 and the intermediate face 122. The intermediate main surface 108 may have tapered edges that are angled or sloped toward the stepped passage 159. Another step may be formed in the bottom portion 156 of the stepped passage 159. The step may be flush with outer main surface 115 and may be angled or sloped. The step may also be raised with respect to the outer main surface 115.

Figure 27:
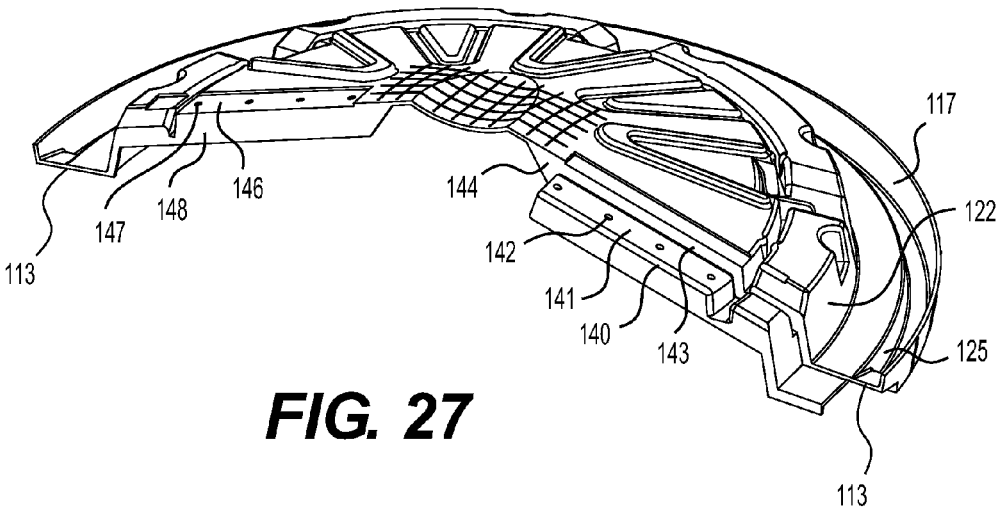
FIG. 27 is a top view of a shield segment according to an embodiment of the present invention.

FIG. 27 is a top view of a shield segment according to an embodiment of the present invention. FIG. 27 shows the connection member 140 and the connection portion 146 that is formed on each shield segment 112. A connection portion 146 may be formed on one side of a cover segment along the seam 113. The connection portion 146 may be recessed with respect to the top surface of the top main surface 107 and may be recessed with respect to the top surface of the intermediate main surface 108. The connection portion 146 may be a surface that a bracket of the bracket assembly 116 engages with upon assembly of the shield using at least two shield segments 112. The depth of the recession of the connection portion 146 may be such that a top surface of a top bracket 130 is flush with the top main surface 107. In addition, one or more holes 147 may be formed in the connection portion to receive rivets of the connection assembly 116. Further, as shown, a connection portion tab 148 extends in a downward direction off the seam 113 and may extend at a right angle or oblique angle with respect to the top main surface 107. The connection portion tab extends downward in the vertical direction at least enough to enter a radial slot 143 of a connection member 140 of another shield segment 112.

A connection member 140 may be formed along a seam 113 at a right angle on a side opposite of the shield segment 112 that the connection portion 146 is formed. The connection member 140 may include a slot 143 in the radial direction through at least one of the top main surface 107, intermediate main surface 108, outer main surface 115, and outer edge 118. The radial slot 143 may have a depth at least sufficient enough for a connection portion tab 148 of another shield segment 112 to enter. In other words the depth of the radial slot 143 may correspond of the depth of the connection portion tab 148. The connection member 140 may be sloped or angled away from center in a downward direction. Further, at a same radial distance from a center of the shield segment 112, the top surface 141 of the connection member 140 is lower in the vertical direction than the top main surface 107. As shown, one or more holes 142 may be provided in the connection member 140.

Upon assembly or connection of two, for example, shield segments 112, the connection portion 146 of one shield segment 112 fits overtop of the connection member 140 of another shield segment 112. The slot 143 accepts the connection portion tab 148. In other words, the connection portion tab 148 fits in the slot 143 and the slot 143 may make a mechanical connection with the connection portion tab 148. Additionally, the top surface 141 of the connection member may abut the bottom surface (underneath) of the connection portion 146.

Figure 28:
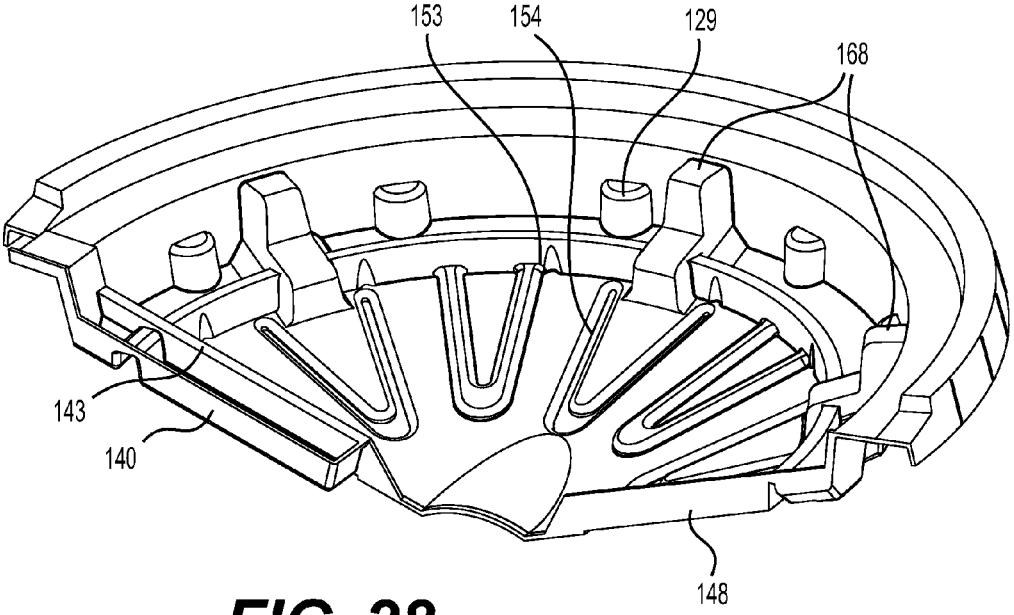
FIG. 28 is a bottom view of a shield segment according to an embodiment of the present invention.

FIG. 28 is a bottom view of a shield segment according to an embodiment of the present invention. FIG. 28 shows the bottom surfaces of the depressions 129 and the bottom surfaces of the stepped passage 159. The bottom surface of the stepped passage 159 may have a contact portion 168 which may come into contact with the top surfaces of the support structure 101. FIG. 28 also shows the bottom surfaces of the slot 143 of the connection member 140 and the connection portion tab 148. Additionally, FIG. 28 shows the bottom surfaces of convex formed radial ribs 154 and concave formed radial channels 153.

Figure 29:
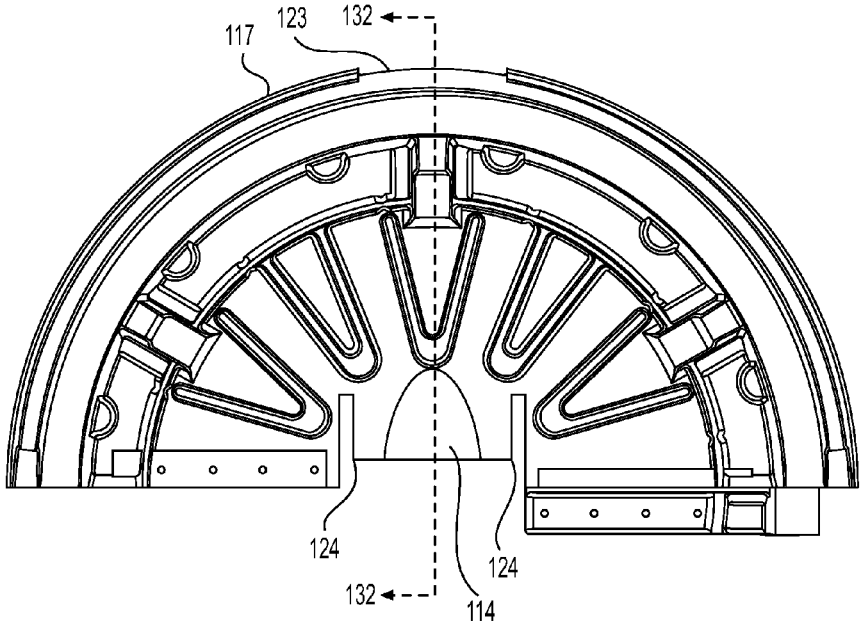
FIG. 29 is a top view of a shield segment showing bearing block notches according to an embodiment of the present invention.

FIG. 29 is a top view of a shield segment showing bearing block notches according to an embodiment of the present invention. FIG. 29 shows a slot 123 formed in the vertical lip 117 and notches or cutouts 124 formed in the vicinity of the center of the top main surface 107. At one stage of manufacturing the center of the top main surface of the shield segment 112 does not include notches 124. The notches 124 may be measured and cut out according to the shape and size of a bearing block 104. In addition, a grid pattern may be formed over the center of the shield segment 112 (shown in FIGS. 26 and 27) as a guide for measuring the notches 124. FIG. 29 also shows a center recess portion 114, which is a dimple or concave portion that biases liquid and debris away from the notches 124.

Figure 30:
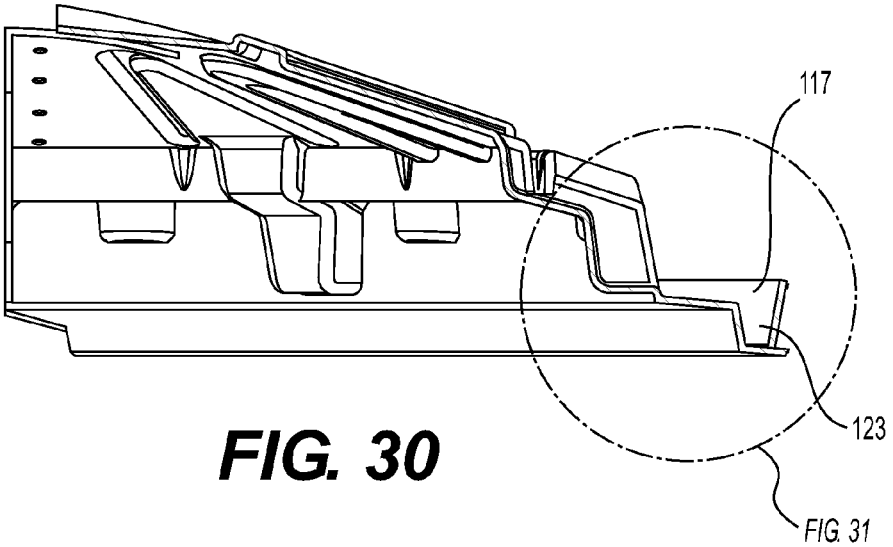
FIG. 30 is a partial cross sectional view along the line 132 of FIG. 29.
Figure 31:
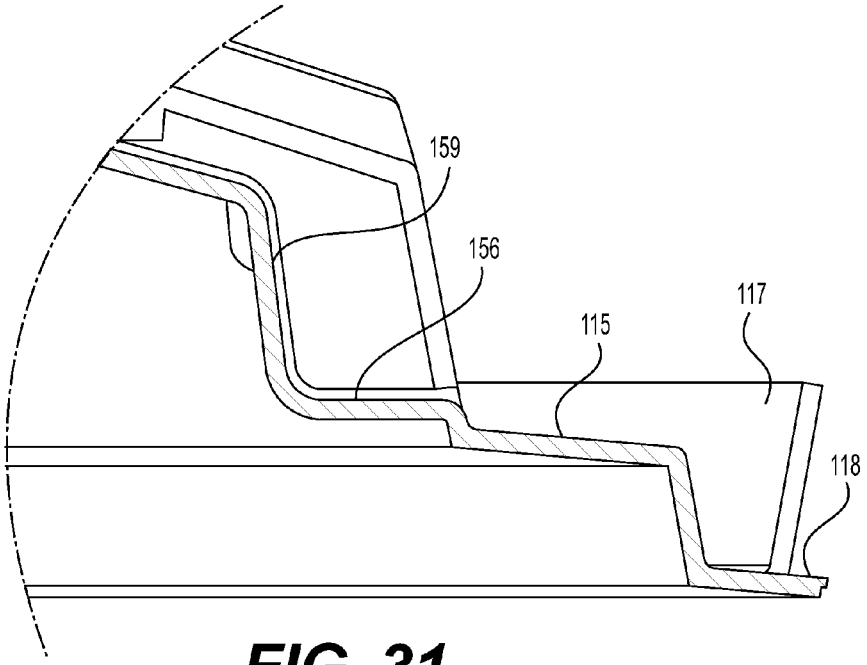
FIG. 31 is a detailed view of the encircled area of FIG. 30 showing the angled surfaces of the shield segment according to an embodiment of the present invention.

FIG. 30 is a partial cross sectional view along the line 132-132 of FIG. 29. FIG. 31 is a detailed view of the encircled area of FIG. 30 showing the angled surfaces of the shield segment according to an embodiment of the present invention. FIG. 31 shows a slot 123 formed by removal of a portion of the vertical lip 117. As shown in the detailed view, the liquid and debris runs off the edge of the outer edge 118 in the area of the slot 123. As mentioned above, the outer edge 118 may be an essentially flat surface that is angled downward at an oblique angle with respect to the flat surface of the outer face 125. Outer main surface 115 is also essentially flat and angled downward at an oblique angle with respect to the intermediate face 122 (although not shown in FIG. 31). FIG. 31 further shows the bottom portion 156 of the stepped passage 159 including a step of the bottom portion 156. As shown in FIG. 31, the vertical lip 117 may not be 90° perpendicular to the outer edge 118; rather, the vertical lip 117 may be angled (oblique) with respect to vertical.

Figure 32:
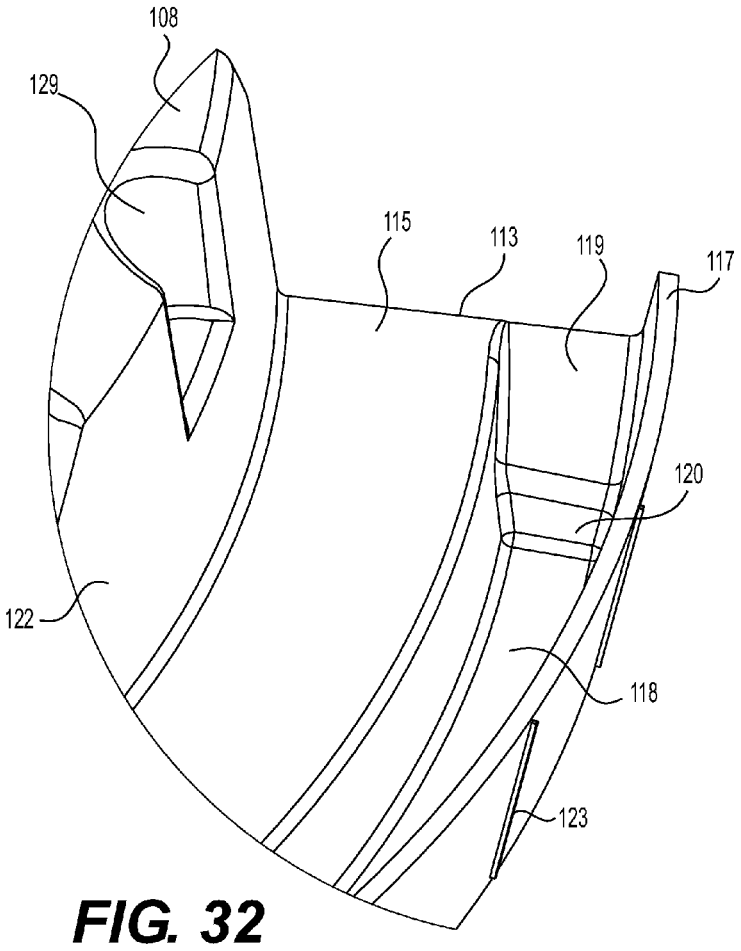
FIG. 32 is detailed perspective view of a shield segment according to an embodiment of the present invention.

FIG. 32 is detailed perspective view of a shield segment according to an embodiment of the present invention. FIG. 32 is a detailed view of the angled portion 119 of the outer edge 118. As shown, the side of the angled portion 119 closest to the seam 113 is higher than the remaining portion of the outer edge 118 in the vertical direction. Between the angled portion 119 and the outer edge 118, an angled step 120 may be formed. The angled portion 119 serves to bias liquid and debris away from the seam. Each end of the outer edge 18 may be provided with the angled portions 119. The top of the angled portion 119 near the seam 113 may be flush with or at a same height in the vertical direction as the outer main surface 115.

Figure 33:
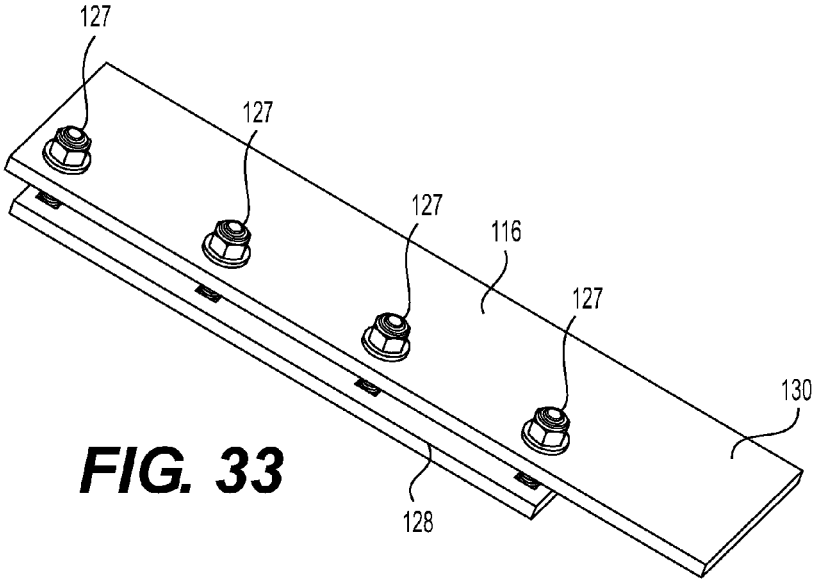
FIG. 33 is a perspective view of a bracket assembly according to an embodiment of the present invention.

FIG. 33 is a perspective view of a bracket assembly according to an embodiment of the present invention. The bracket assembly 116 may include a top bracket 130, bottom bracket 128, and one or more rivets 127 (e.g., bolts) for securing the top bracket 130 and the bottom bracket 128. With reference to FIG. 29, a top bracket 130 may engage with the surface of the connection portion 146 and a bottom bracket 128 may engage with a bottom surface of the connection member 140. The bolts 127 are placed through corresponding holes 142 and 147. FIG. 33 shows the top bracket 130 and the bottom bracket 128 having a rectangular shape, however, this is merely one example and brackets of other shapes may be used. In addition, other bracket techniques known in the art may be used to connect shield segments 112 using the connection portion 146 and connection member 140.

Figure 34:
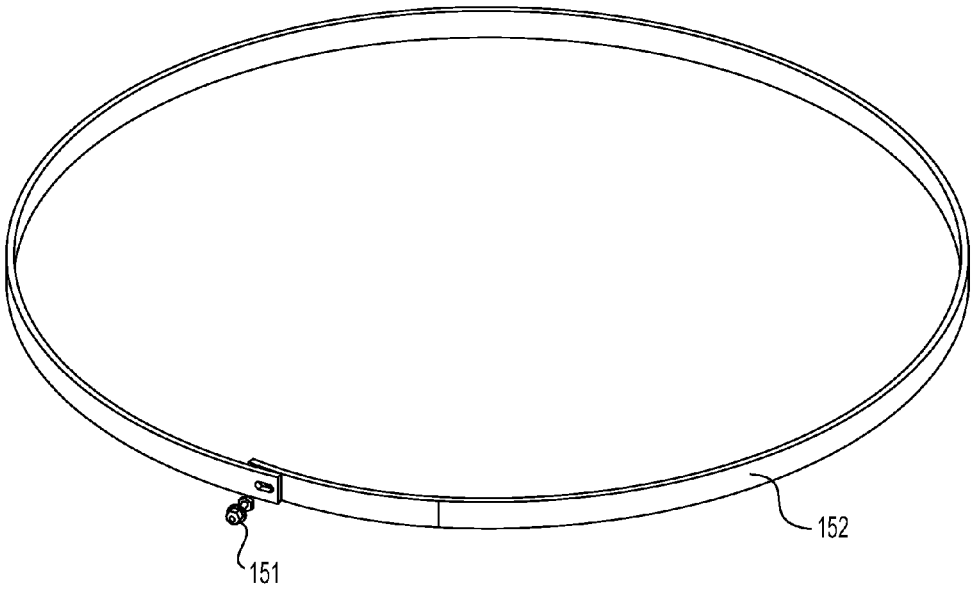
FIG. 34 is a perspective view of a collar according to an embodiment of the present invention.

FIG. 34 is a perspective view of a collar according to an embodiment of the present invention. In an embodiment the collar 152 is made of rust resistant metal (e.g., aluminum). The collar 152 can be any length suitable for securing the connection of the shield segments. The shape of the collar 152 is generally round to fit into the collar channel 150. One end of the collar 152 may attach to another end of the collar 152 using a bolt assembly 151.

Figure 35:
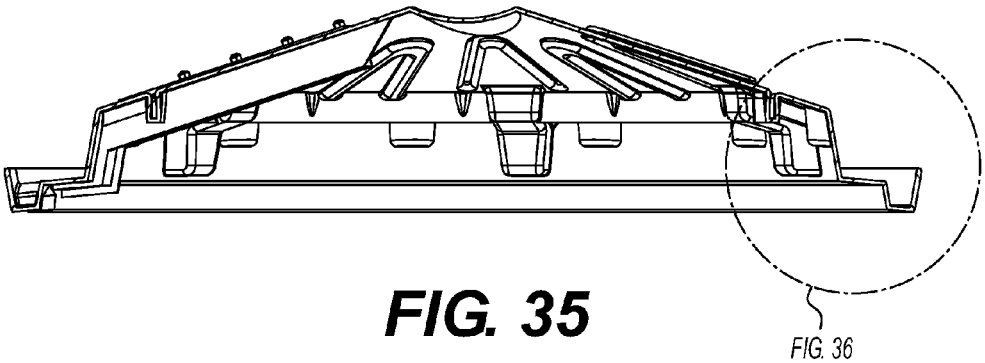
FIG. 35 is a cross sectional view along the line 134-134 of FIG. 25.
Figure 36:
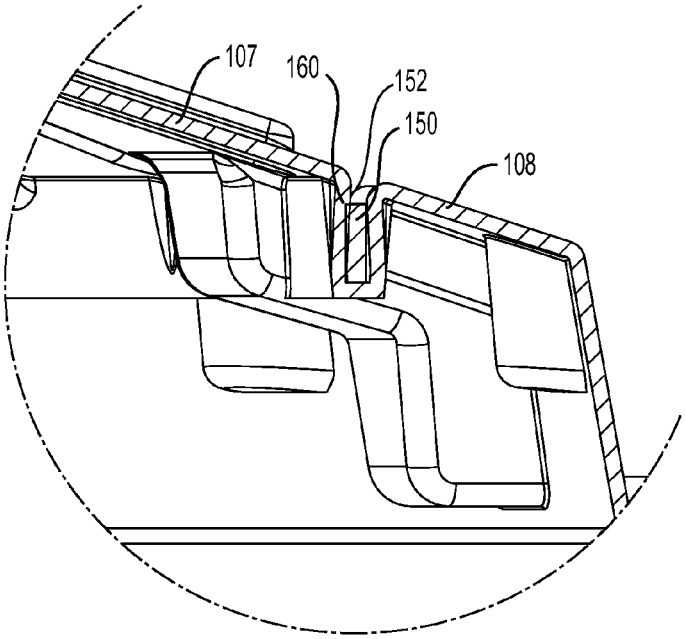
FIG. 36 is a detailed view of the encircled area of FIG. 35 showing the angled surface of the collar channel according to an embodiment of the present invention.

FIG. 35 is a cross sectional view along the line 134-134 of FIG. 25 and FIG. 36 is a detailed view of the encircled area of FIG. 35 showing the angled surface of the collar channel according to an embodiment of the present invention. FIG. 36 shows that at least a portion of the face 160 of the collar channel 150 that is closest to the center of the shield segment 112 has a cavity forming an "under cut," which prevents the collar 152 from slipping out of the collar channel 150 when the collar 152 is installed. One or more portions of the face of the collar channel 150 may have the cavity 160. The cavity 160 may mechanically engage the collar 152.

Figure 37:
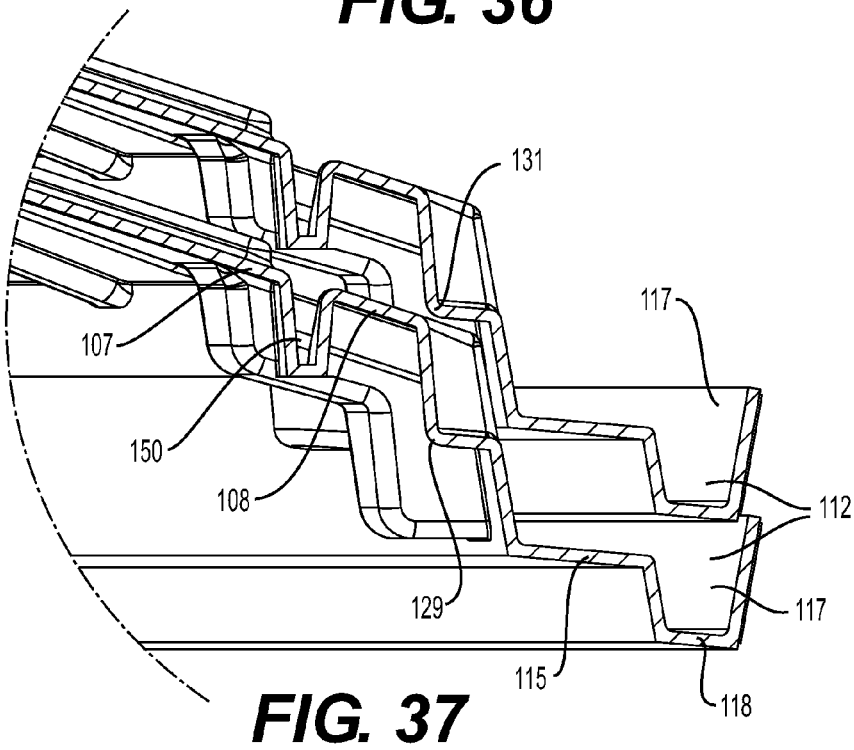
FIG. 37 is a cross sectional view of two shield segments stacked on one another, which shows the stacking and nesting elements of the shield segments.

FIG. 37 is a cross sectional view of two shield segments stacked on one another, which shows the stacking and nesting elements of the shield segments. A bottom surface 131 of the depression 129 may contact a top surface of top surface of the intermediate main surface 108 upon nesting multiple shield segments 112.

It is further understood by those skilled in the art that although the foregoing description has been made on embodiments of the invention, the invention is not limited thereto and various changes and modifications may be made without departing from the spirit of the invention and the scope of the appended claims.

What is claimed is:

1. A top cover segment of a modular top cover in which two or more of said top cover segments are connectable for covering the top of a support structure and for shielding the surfaces of the support structure and a surface of a horizontal support structure member from liquid and debris, the top cover segment comprising:

the top cover segment having substantially a semi-circular profile and having a top main surface, an intermediate main surface, an outer edge, and a seam spanning the diameter of the cover segment;

a first channel disposed between the top main surface and the intermediate main surface and spanning in a circumferential direction;

a second channel spanning in the circumferential direction and at a greater distance from a center portion than the first channel in a radial direction, the center portion is an area of the top main surface near a midpoint of the seam, wherein each of the top main surface, intermediate main surface, and outer edge faces in an upward direction, wherein the seam has a first radial edge and a second radial edge extending in an opposite direction than the second radial edge with respect to the center portion, wherein the center portion is higher, in a vertical direction, than the outer edge, wherein one side of the first channel spans to the first radial edge and a second side of the first channel spans to the second radial edge, and one side of the second channel spans to the first radial edge and a second side of the second channel spans to the second radial edge, wherein an intermediate face extends in a downward direction at an oblique angle with respect to the intermediate surface, the intermediate face faces outward toward the outer edge and spans along the circumference of the intermediate surface, wherein a vertical lip extends in an upward direction at an oblique angle with respect to the outer edge and spans along the circumference of the outer edge, wherein the second channel has the outer edge as a bottom surface and has the vertical lip and the intermediate face as respective side surfaces, wherein the outer edge has a portion extending upward at an oblique angle with respect to a top surface of the outer edge at one of the first radial edge and the second radial edge, wherein a first connection component is disposed along one of the first radial edge and the second radial edge, the first connection component including a recessed portion recessed into the top main surface and a tab extending downward at an oblique angle with respect to the top main surface, and wherein a second connection component is disposed along the other of the first radial edge and the second radial edge, the second component including an extension, in the radial direction beyond the second radial edge, of at least the top main surface, first channel and intermediate main surface, and including a slot along the second radial edge, the slot having a width and a depth corresponding to a width and depth of the tab of the first connection portion.

2. The top cover segment of claim 1, wherein the vertical lip has one or more slots around the circumference of the vertical lip.

3. The top cover segment of claim 1, wherein one or more slots are disposed in the center portion and each extending substantially perpendicular to the seam.

4. The top cover segment of claim 1, further comprising:

a round-shaped depression disposed in the center portion.

5. The top cover segment of claim 1, further comprising:

one or more passages each extending in the radial direction through each of the first channel, intermediate main surface, and intermediate face, and each passage opens into the second channel and has at least one step facing upward, and wherein the one or more passages are spaced apart at a regular interval.

6. The top cover segment of claim 1, further comprising:

one or more ribs protruding from the top main surface and extending in the radial direction; and one or more radial channels disposed in the top main surface and extending in the radial direction, wherein the one or more ribs are spaced apart at a regular interval, wherein the one or more radial channels are spaced apart at a regular interval, and wherein each of the one or more channels has a spout portion disposed at the first channel.

7. The top cover segment of claim 1, wherein a face of the first channel has one or more convex portions spaced apart at regular intervals protruding into the first channel.

8. The top cover segment of claim 1, wherein at least the top main surface, intermediate main surface, outer edge, first channel, and second channel are formed as one piece.

9. The top cover segment of claim 8, wherein the cover segment is formed of high density polyethylene.

10. The top cover segment of claim 1, wherein a width of the first channel in the radial direction is less than a width of the second channel.

11. The top cover segment of claim 1, wherein one or more holes are formed in each of the first connection portion and second connection portion.

* * * * *